US005474036A

United States Patent [19]

Hansen et al.

[11] Patent Number: 5,474,036

[45] Date of Patent: Dec. 12, 1995

[54] INTERNAL COMBUSTION ENGINE WITH ROTARY VALVE ASSEMBLY HAVING VARIABLE INTAKE VALVE TIMING

[75] Inventors: Craig N. Hansen, Eden Prairie; Paul C. Cross, Shorewood, both of Minn.

[73] Assignee: Hansen Engine Corporation, Minnetonka, Minn.

[21] Appl. No.: 201,794

[22] Filed: Feb. 25, 1994

[51] Int. Cl.[6] ..... F01L 7/10

[52] U.S. Cl. ..... 123/80 BB; 123/80 C; 123/190.4

[58] Field of Search ..... 123/80 R, 80 BB, 123/80 C, 190.4, 190.12, 190.6

[56] References Cited

U.S. PATENT DOCUMENTS

| | | | |
|---|---|---|---|
| 1,632,517 | 6/1927 | Stickney . | |
| 1,711,781 | 5/1929 | Gibson et al. | 123/80 C |
| 1,839,458 | 1/1932 | Anglada | 123/80 C |
| 1,859,199 | 5/1932 | Davison et al. | 123/80 C |
| 2,017,198 | 10/1935 | Anglada et al. | 123/80 C |
| 2,245,743 | 6/1941 | Aspin . | |
| 3,993,036 | 11/1976 | Tischler | 123/190 A |
| 4,098,514 | 7/1978 | Guenther | 123/190 E |
| 4,481,917 | 11/1984 | Rus et al. | 123/190.4 |
| 4,494,500 | 1/1985 | Hansen | 123/80 BB |
| 4,572,116 | 2/1986 | Hedelin | 123/190 B |
| 4,612,886 | 9/1986 | Hansen et al. | 123/80 BB |
| 4,774,913 | 10/1988 | Giampa et al. | 123/90.16 |
| 4,867,117 | 9/1989 | Scalise | 123/80 BB |
| 4,961,406 | 10/1990 | Burandt | 123/90.15 |
| 5,000,136 | 3/1991 | Hansen et al. | 123/80 BB |
| 5,081,966 | 1/1992 | Hansen et al. | 123/80 BB |
| 5,209,194 | 5/1993 | Adachi et al. | 123/90.17 |

OTHER PUBLICATIONS

Ahmad et al "A Survey of Variable–Valve–Actuation Technology", SAE Paper No. 891674, Jan. 1989.

Asmus, T. W. "Perspectives on Applications of Variable Valve Timing", SAE Paper No. 910455, Jan. 1991.

Dresner et al "A Review of Variable Valve Timing", SAE Paper No. 891676, Jan. 1989.

Yasuhiro et al "A Study of Vehicle Equipped With Non–Throttling S.I. Engine With Early Intake–Valve Closing Mechanism", SAE Paper No. 930820, Jan. 1993.

Elrod et al "Development of a Variable Valve Timed Engine to Eliminate the Pumping Losses Associated With Throttled Operation", SAE Paper No. 860537, Feb. 24, 1986.

Tuttle, J. "Controlling Engine Load by Means of Early Intake–Valve Closing", SAE Paper No. 820408, Jan. 1982.

*Primary Examiner*—David A. Okonsky

*Attorney, Agent, or Firm*—Burd, Bartz & Gutenkauf

[57] ABSTRACT

An internal combustion engine has rotary valves associated with movable shutters operable to vary the closing of intake air/fuel port sections to obtain peak volumetric efficiency over the entire range of speed of the engine. The shutters are moved automatically by a control mechanism that is responsive to the RPM of the engine. A foot-operated lever associated with the control mechanism is also used to move the shutters between their open and closed positions.

43 Claims, 18 Drawing Sheets

INTERNAL COMBUSTION ENGINE WITH ROTARY VALVE ASSEMBLY HAVING VARIABLE INTAKE VALVE TIMING

The U.S. Government has a paid-up license in this invention and the right in limited circumstances to require the patent owner to license others on reasonable terms as provided for by the terms of contract DAAE07-84-CRO 89, awarded by the U.S. Army and contract DEFG01-89-CE 90049, awarded by the U.S. Department of Energy

FIELD OF THE INVENTION

The invention pertains to an internal combustion engine having reciprocating pistons and rotary valve assemblies for controlling the flow of intake an air/fuel mixture, and exhaust gases into and out of rotary valves having valving combustion chambers with variable intake air/fuel valve timing.

BACKGROUND OF THE INVENTION

Internal combustion engines having rotary valves provided with combustion chambers are disclosed by C. N. Hansen and P. C. Cross in U.S. Pat. Nos. 4,612,886; 4,773,364; 4,813,392; 5,000,136; and, 5,081,966. The rotary valves disclosed in these patents do not have any structure or methods for varying the intake valve timing. Conventional throttle plates are used to control the flow of air/fuel mixture to the combustion chambers of the rotary valve. Hydrocarbon fuel engine efficiencies can be improved by reducing the engine's pumping losses. The pumping losses contribute significantly to the lowering of the engine's operational efficiency and are negative work required by an engine to pump air through it. The pumping losses are due primarily to the resistance associated with the air as it flows past the throttling valve of a conventional carburetor on its way to the combustion chamber. The standard spark/ignition engine is most efficient when it is at wide-open throttle where the pumping losses are minimal. In the speeds of the typical motor vehicle engine, the majority of its time of operation is at part/throttle and idle. The elimination of the throttling process of an internal combustion engine by running the engine at wide-open throttle throughout its load/speed range improves the average overall efficiency of the engine by approximately twenty percent.

Variable valve timing is the scheduling of the valve timing events throughout an combustion engine's load/speed range. Electronically operated variable cam shafts used with poppet valves have been designed to regulate the amount of air/fuel mixture available for the combustion process. The load control of the engine is maintained without a throttle valve. Disclosures of examples of this type of variable valve timing apparatus is found in U.S. Pat. No. 4,774,913 and U.S. Pat. No. 15,209,194.

SUMMARY OF THE INVENTION

The present invention relates to an internal combustion engine having rotary valve assemblies with combustion chambers and variable valve timing shutters to close the intake valve port to obtain peak volumetric efficiency at all desired operating engine speeds. A throttle valve is not used, thereby eliminating the throttling losses created thereby. The intake manifold has no throttle so that the intake air/fuel mixture is essentially at atmospheric pressure. Fuel economy gains are achieved by the reduction of the pumping losses due to the variable inlet valve timing. The variable valve timing is also used to limit peak pressures to acceptable levels when burning fuels which would otherwise be prone to detonation.

The internal combustion engine of the invention has a plurality of rotary valves having valve combustion chambers to control air/fuel intake and exhaust gas expulsion from the engine. Each rotary valve is located within a sleeve provided with air/fuel intake and exhaust gas ports. A shutter movably mounted on the sleeve functions to vary the timing of the closing of the intake port to obtain maximum volumetric efficiency of the engine over the full speed range of the engine. A control mechanism connected to the shutter includes a manual operator and an automatic control responsive to the RPM of the engine providing optimum engine operation. In one form of the invention, a pair of shutters are used to control the idle and part load operation of the engine and an increased load to full load operation of the engine. The shutters are a primary shutter for controlling flow of an air/fuel mixture to first inlet port section and valving cut-off at idle and part load. A secondary shutter moves independently of the primary shutter to control the flow of air/fuel mixture to the second inlet port section when the engine is operating at increased load to full load. A valve in the passage leading to the first inlet port section operates in response to the rotation of the rotary valve to allow flow of the air/fuel mixture when the primary shutter is open and the secondary shutter is closed. The valve is closed when the secondary shutter is open. A control mechanism having a progressive motion control simultaneously and sequentially moves the primary and secondary shutters.

The invention includes the method of varying the valve timing of a rotary valve of an internal combustion engine in response to the RPM of the engine to obtain peak volumetric efficiency over the entire operating speed of the engine.

DESCRIPTION OF A PREFERRED EMBODIMENT

Figure 1:
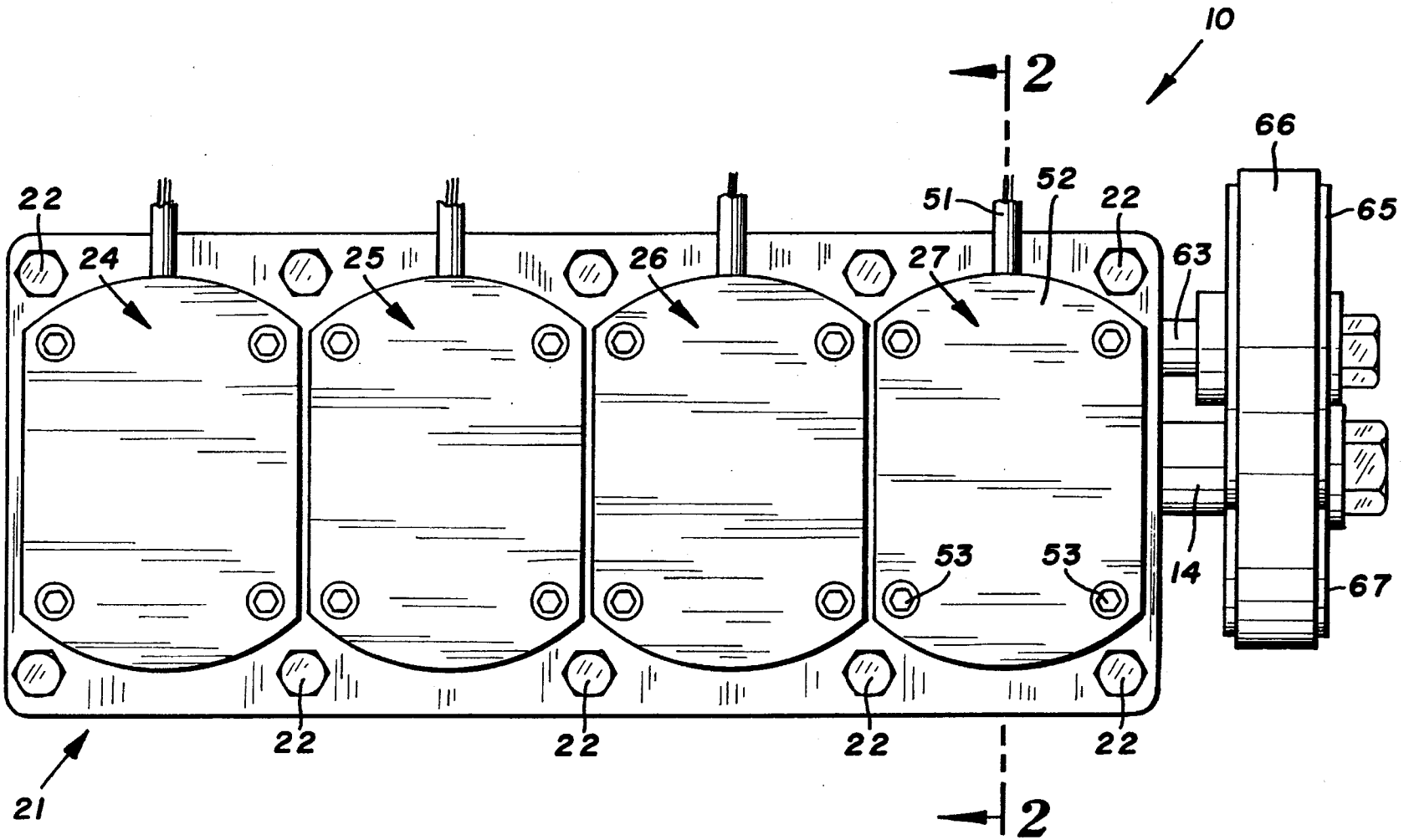
FIG. 1 is a top plan view of an internal combustion engine having the rotary valve assemblies with variable inlet valve timing of the invention.
Figure 2:
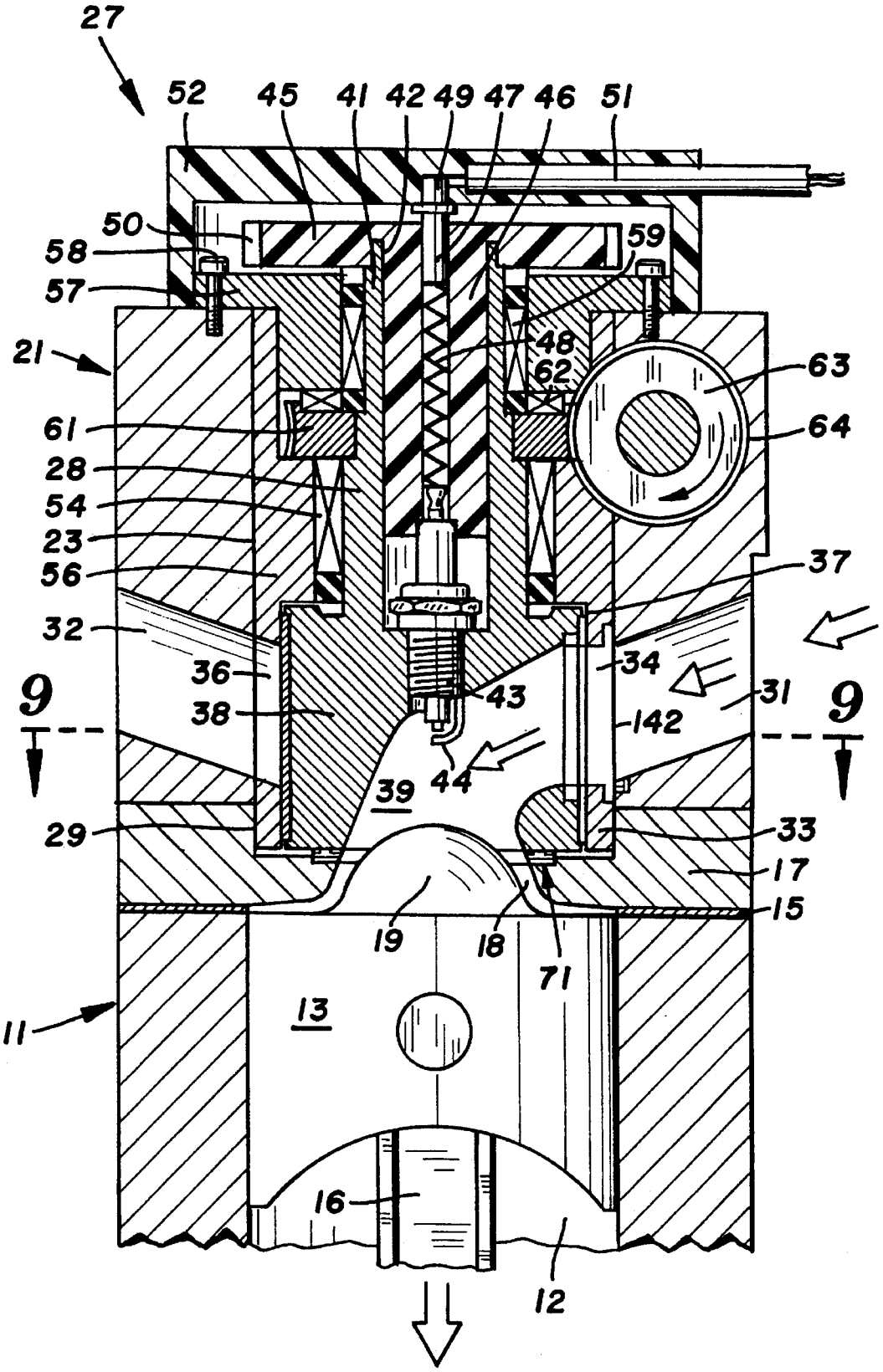
FIG. 2 is an enlarged sectional view taken along the line 2—2 of FIG. 1 showing the rotary valve in the air/fuel intake position with the piston at head dead center.

Referring to FIGS. 1 and 2, there is shown a four cylinder internal combustion engine, otto cycle, indicated generally at 10, equipped with rotary valve assemblies 24, 25, 26 and 27 having rotary valves with combustion chambers and variable valve timing mechanisms. The rotary valve with variable valve timing is applicable to a single cylinder internal combustion engine and multiple cylinder internal combustion engines, such as three, six and eight cylinder engines. The valve timing mechanism optimizes the engine parameters relating to emissions, economy and performance at an infinite number of load/speed points. Pumping losses are substantially reduced. The air/fuel mixture introduced into the rotary valving combustion chambers stratifies to allow effective ignition in lean burn environments. Dual fuels, such as gasoline and ethanol, can be used to operate the engine without detonation effects. The engine can be operated at higher RPM than engines having poppet valves resulting in greater power output with a relative light weight structure.

Engine 10 has a block 11 containing four upright cylinders or bores 12. Each bore slideably accommodates a reciprocating piston 13 having conventional piston ring (not shown). Each piston 13 has an upwardly directed semi-hemispherical projection 19 that increases the compression of the air/fuel mixture in the rotary valve combustion chamber 39 and facilitates a generally cylindrical expanding flame front over the top of piston 13 during the power stroke. Each piston 13 is connected to a conventional crank shaft 14 with a connecting rod 16.

As shown in FIG. 2, a flat metal head plate or fire deck 17 is mounted on top of block 11. A gasket 15 is interposed between the bottom of plate 17 and the top of block 11. Block 11, head plate 17 and head 21 can be a one-piece structure, such as cast metal. Bores 23 in head 21 and bores 12 in block 11 can be machined at opposite sides of the head plate portion of the structure. This eliminates gasket 15 as the head plate is joined with the block and head. Head plate 17 has a circular opening 18 aligned with the central vertical axis of bore 12 and the axis of piston 13 slideably located within bore 12. Opening 18 diverges outwardly and downwardly toward the cylinder chamber. Plate 17 has a convex curved wall forming opening 18. Opening 18 is aligned with, but not necessarily concentric, with each bore 12 in block 11. Substantially all of the air and air/fuel mixture in valving combustion chamber 39 is exposed to a flame front which reduces HC emissions and improves fuel economy.

A head, indicated generally at 21, is mounted on top of head plate 17. As seen in FIG. 1, a plurality of bolts 22 secure head plate 17 to block 11. Head 21 has a vertical bore 23 accommodating the rotary valve assembly, indicated generally at 27. Additional vertical bores in head 21 accommodate rotary valve assemblies 24, 25 and 26. Each of the rotary valve assemblies 24–27 are identical. The following description is directed to rotary valve assembly 27.

As seen in FIGS. 2–5, rotary valve assembly 27 has an upright cylindrical sleeve, indicated generally at 28. Sleeve 28 is made of self-lubricating material, such as a high-density and low friction carbon, interposed in bore 23. Ceramic materials, such as silicon nitride, silicon carbide or a ceramic including silicon aluminum, oxygen, nitrogen and other materials can be used for sleeve 28. The lower section 33 of sleeve 28 is located in a cylindrical recess 29 in the top of head plate 17. The bottom of section 33 is spaced a short distance above the bottom of recess 29 to allow for thermal expansion of the materials and metals. Head 21 has an intake passage or port 31 and exhaust passage or port 32 that project upwardly and outwardly at angles of approximately 20 degrees relative to a horizontal plane to facilitate flow of gases into and out of combustion chamber 39. The lower section 33 of sleeve 28 is a cylindrical flange or ring with intake ports having port sections 34 and 35 in communication with intake port 31 and an exhaust port 36 aligned with exhaust port 32. Section 33 has an inside cylindrical wall 37 surrounding the body of a rotary valve 38 having internal combustion chamber 39.

An upright cylindrical tubular stem 41 is joined with the top of the body of rotary valve 38. Stem 41 has a cylindrical recess or pocket 42 accommodating an igniter or spark plug 43. Spark plug 43 is threaded .into a bore in the body of valve 38. The inner end of spark plug 43 has spaced points or electrodes 44 located within a central portion of combustion chamber 39. A cap 45 of electrical insulative material has an elongated cylindrical body 46 extended into recess 42. The outer edge of cap 45 has gear teeth 50, the function of which is hereinafter described. The upper end of cap 45 accommodates a cylindrical metal plug or contact 47 that is biased upwardly with a coil spring 48 located within the central passage of cap 45. Spring 48 is attached to the outer or upper contact of spark plug 43 and contacts plug 47 to provide an electrical connection between spark plug 43 and plug 47. Plug 47 is continuously biased by spring 48 into engagement with a contact member 49 connected to an ignition wire 51. Contact member 49 and ignition wire 51 are located within a cover 52 secured to the top of head 21 with a plurality of bolts 53, as seen in FIG. 1. Ignition wire 51 leads to the ignition controls (not shown) of the internal combustion engine.

The body and stem of rotary valve 38 are rotatably mounted on sleeve 28 with a bearing 54 positioned within an annular inwardly directed body portion 56 of sleeve 28. A collar 57 surrounding the upper section of sleeves 41 fits into the upper end of sleeve 28. A plurality of bolts 58 secure collar 57 to head 21. A second bearing 59 is interposed between collar 57 and stem 41. Bearings 54 and 59 can be sleeve bearings, roller bearings or needle bearings which rotatably mount the body of valve 38 about a generally vertical axis. A gear 61, having external worm teeth, is mounted on stem 41 below collar 57 for rotation with valve 38. Gear 61 is keyed or splined to stem 41. The lower side of gear 61 extends over the top edge of body portion 56 and bearing 54. A thrust bearing 62 is interposed between gear 61 and the bottom of collar 57. Gear 61 is in driving engagement with a worm gear or spiral drive 63. Worm gear 63, extended longitudinally in a passage 64 in head 21 is rotatably mounted on head 21 with suitable bearings (not shown). Worm gear 63 is rotated with a belt and pulley power transmission from crank shaft 14. As seen in FIG. 1, a driven pulley 65 is mounted on the outer end of worm gear 63. A timing belt 66 operatively connects pulley 65 to a drive pulley 67 connected to crank shaft 14. Other types of power transmitting structures, such as gears, roller chains and electric motors can be used to rotate valve body 38 in a 2 to 1 timing relation with the rotation of crank shaft 14.

Figure 5:
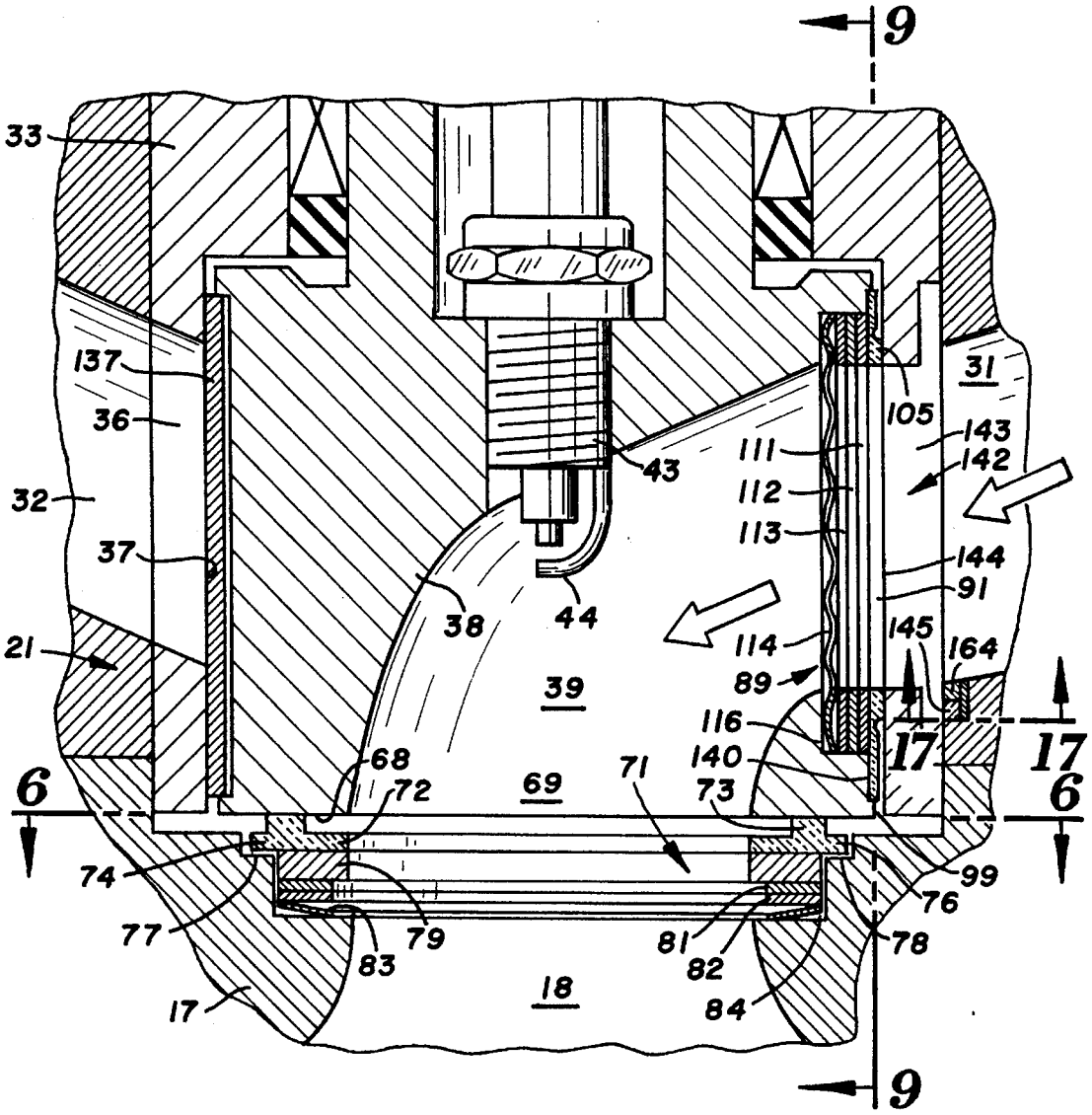
FIG. 5 is an enlarged sectional view of a portion of the rotary valve assembly of FIG. 2 showing the bottom and side seal assemblies associated with the rotary valve.
Figure 6:
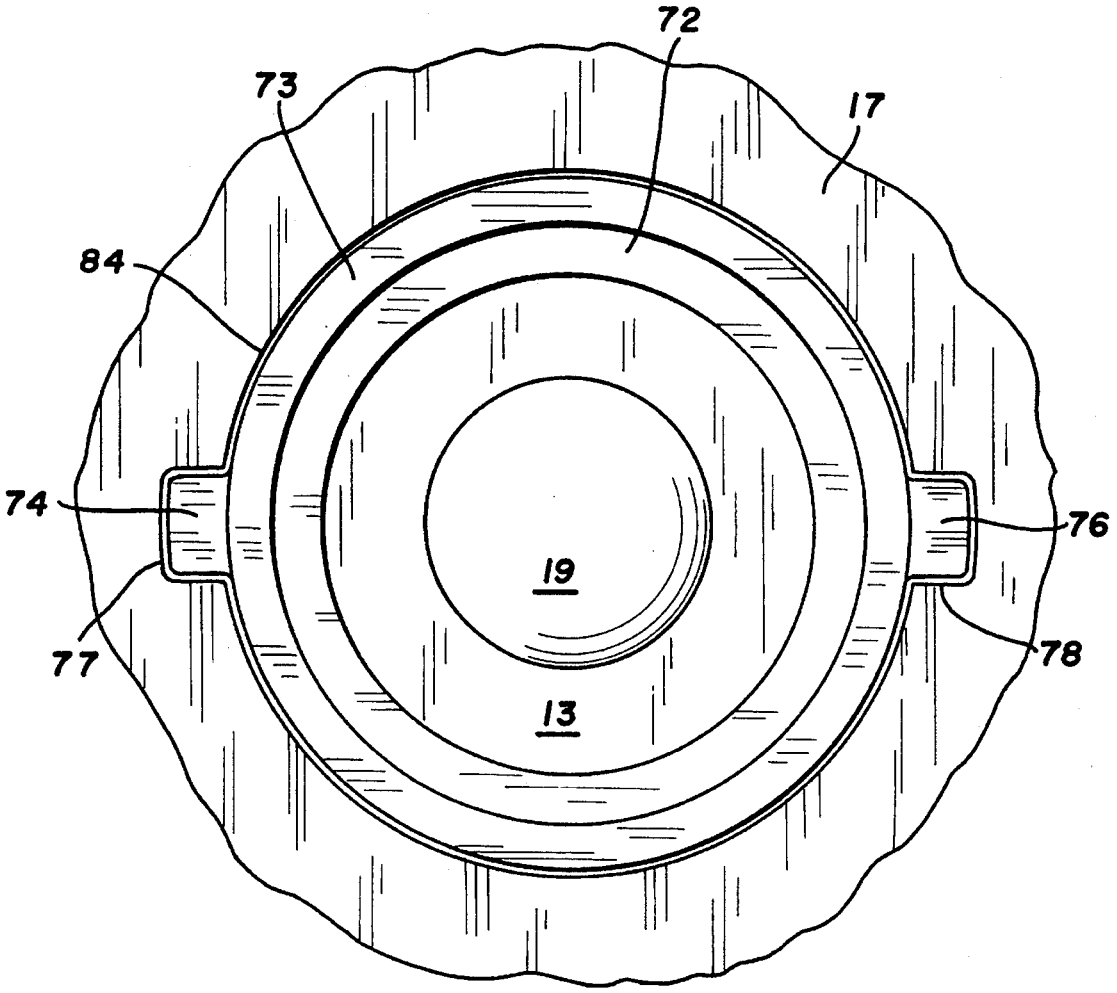
FIG. 6 is a sectional view taken along the line 6—6 of FIG. 5.
Figure 7:
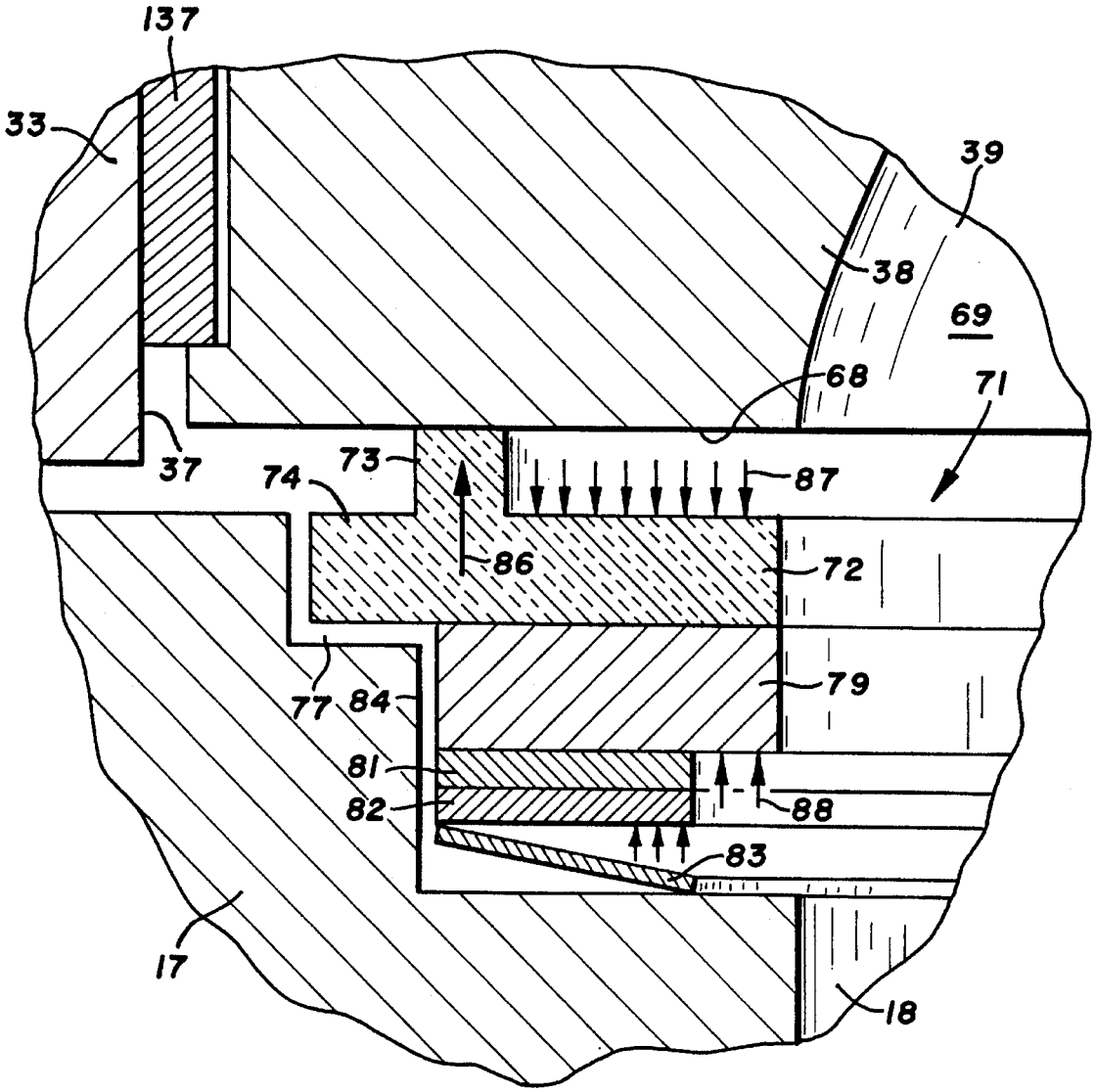
FIG. 7 is an enlarged sectional view of the bottom seal assembly associated with the rotary valve assembly.

Referring to FIG. 5, the body of rotary valve 38 has an annular flat bottom face 68 surrounding a circular opening 69 aligned with circular opening 18 in head plate 17. Opening 69 has a diameter that is substantially the same as the minimum diameter of opening 18. A first or face seal assembly, indicated generally at 71, is located between bottom face 68 and head plate 17 to prevent leakage of gases into the annular space around the body of valve 38 and to intake and exhaust ports 31 and 32. Face seal assembly 71 has an annular plate 72 having an upwardly directed annular rib 73 having a top surface in sliding sealing engagement with bottom face 68. Plate 72 has opposite outwardly extended fingers 74 and 76, as seen in FIG. 6, projected into pockets 77 and 78 in head plate 17 to prevent rotation of plate 72. Plate 72 rests on an annular ring 79 located above a pair of annular members or washers 81 and 82. A spring, shown as an inclined washer 83, biases plate 72 in an upward direction, as indicated by arrow 86 in FIG. 7, whereby the top annular surface of rib 73 is in surface sealing engagement with the bottom face 68 of valve 38. Plate 72, ring 79, and washers 81, 82 and 83 are located within an annular recess or groove 84 in the top of head plate 17. Recess 84 surrounds the upper end of opening 18. As shown in FIG. 7, an inner annular portion of washer 72 is spaced below bottom face 68 and is subjected to the pressure of the gases in combustion chamber 39 and opening 18, indicated by arrow 87. The pressure on head plate 72 is in a downward direction. An opposite and upwardly directed pressure on ring 79 and washer 82, indicated by arrows 88, balances the downward pressure, indicated by arrows 87. Accordingly, the high gas pressure in combustion chamber 39 and opening 18 during the combustion and power strokes of piston 13 does not reduce the sealing effectiveness of seal assembly 71. The relatively low biasing force of spring 83 is sufficient to maintain an effective seal between annular rib 73 and bottom face 68 without excessive wear or friction losses.

Figure 8:
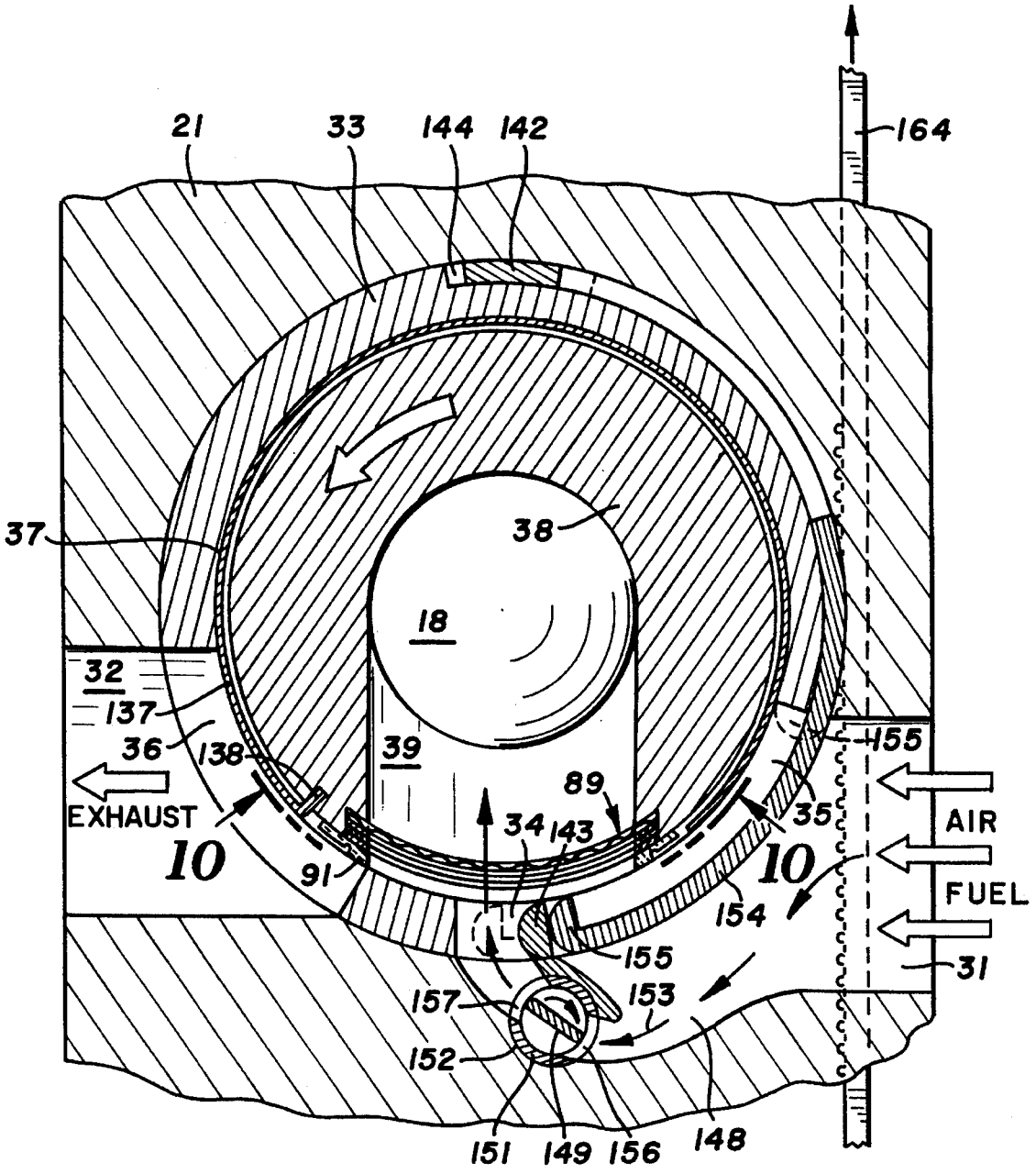
FIG. 8 is a transverse sectional view similar to FIG. 9 showing the valve assembly in the initial air/fuel intake position.
Figure 9:
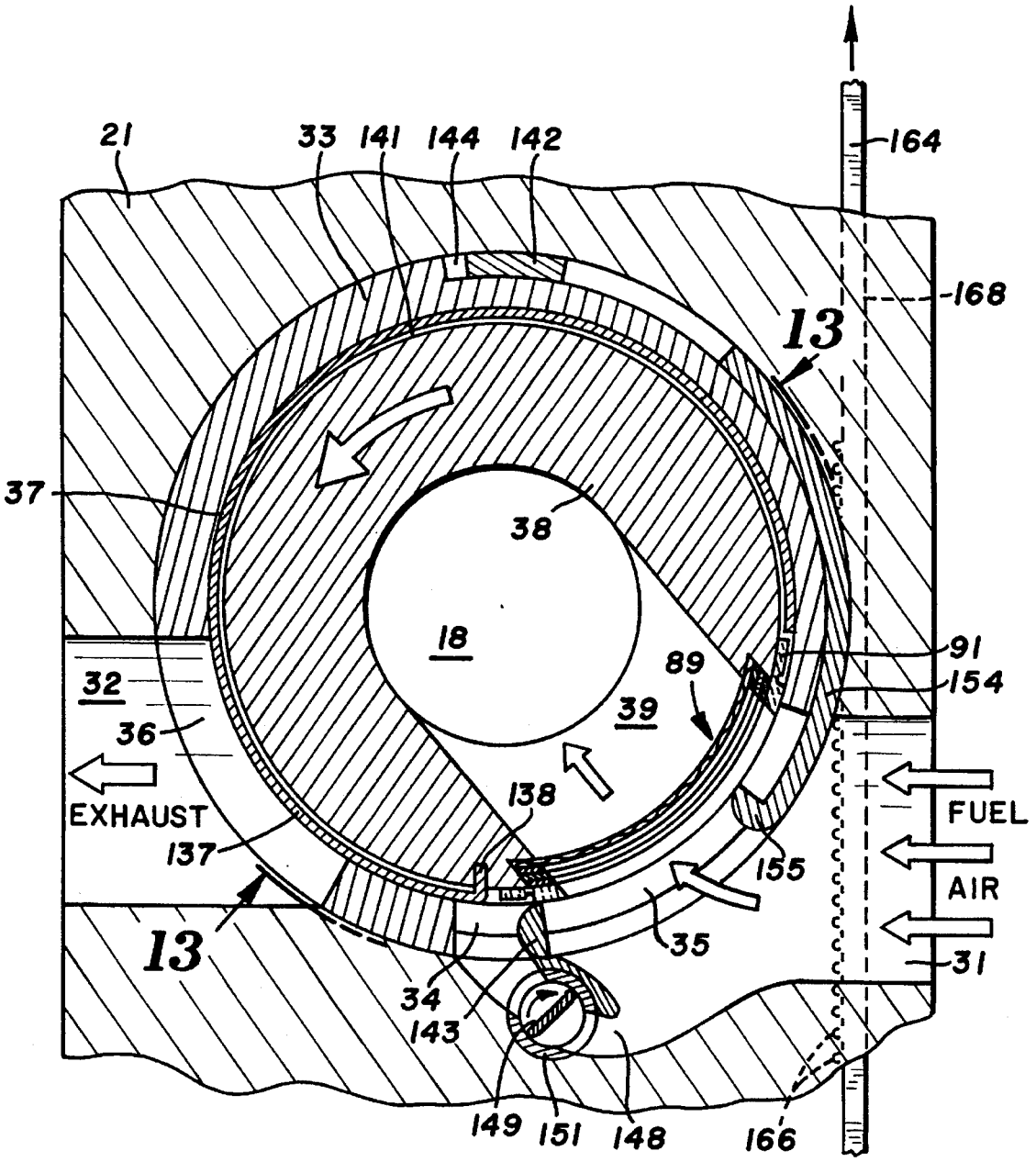
FIG. 9 is an enlarged sectional view taken along the line 9—9 of FIG. 2.
Figure 11:
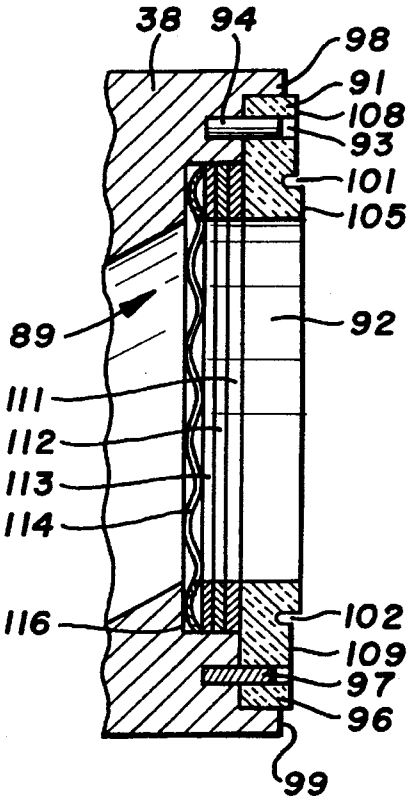
FIG. 11 is a sectional view taken along the line 11—11 of FIG. 10.
Figure 10:
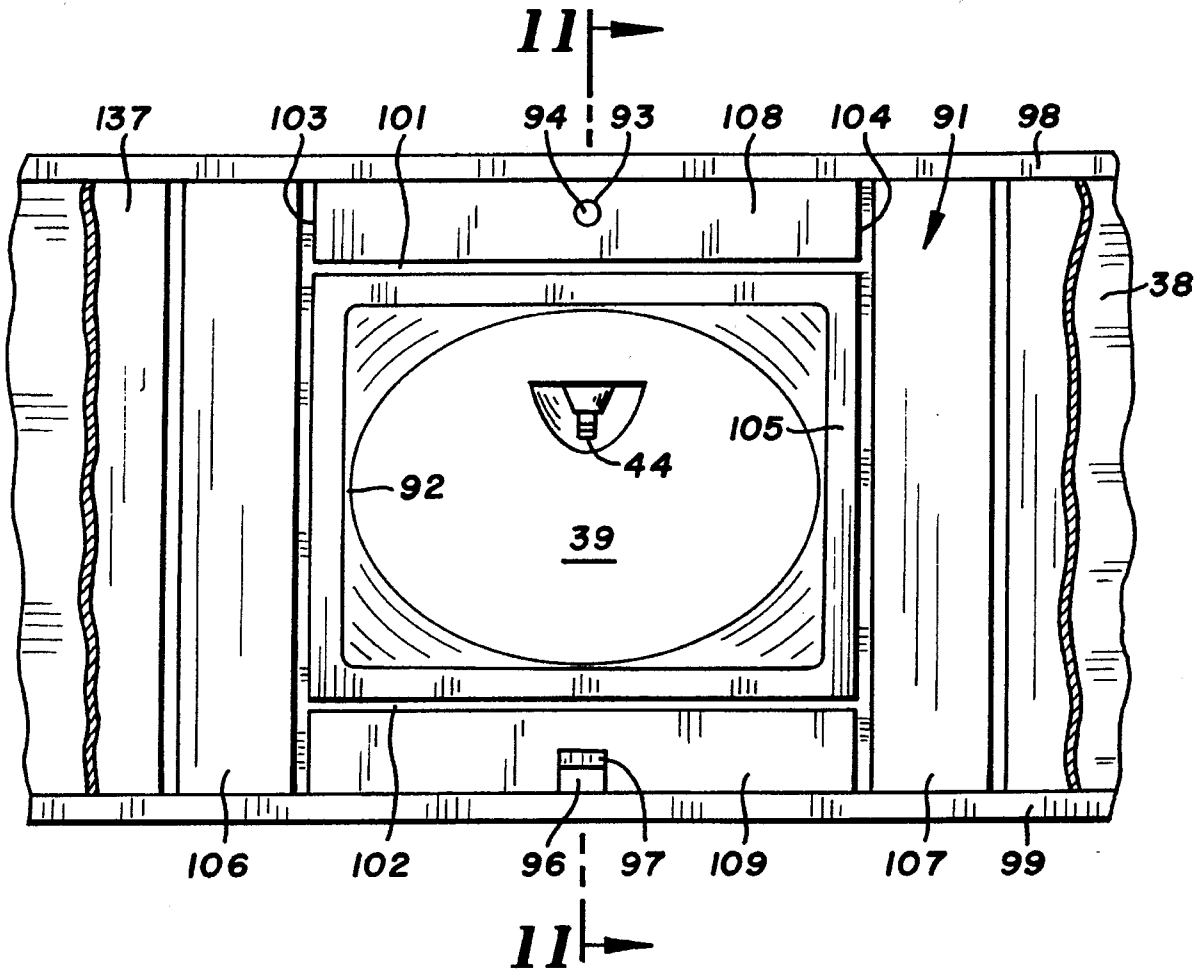
FIG. 10 is an enlarged sectional view taken along the line 10—10 of FIG. 8.

A second or arcuate seal assembly, indicated generally at 89 in FIGS. 5, 8 and 9, surround the perimeter of the inlet/exhaust entrance to combustion chamber 39. Arcuate seal and assembly 89 has a sealing member 91 with a generally rectangular opening 92 aligned with inlet opening 31 and exhaust opening 32. As seen in FIGS. 10 and 11, the upper central portion of sealing member 91 has a hole 93 accommodating a pin 94. Pin 94 is attached to the body of valve 38. The lower central portion of sealing member 91 has an upwardly directed slot 96 accommodating a flat pin 97. Flat pin 97 fits into a hole in the body of valve 38. Pins 94 and 97 allow sealing member 91 to move inwardly and outwardly and have limited rocking motion without circumferential movement relative to the body of rotary valve 38. Valve 38 has annular outwardly directed upper and lower circular flanges 98 and 99. Sealing member 91 extends between flanges 98 and 99 and over arcuate segments of the outside wall of the body of valve 38. Returning to FIG. 10, the outer face of sealing member 91 has upper and lower circumferential grooves 101 and 102 joined to vertical grooves 103 and 104. Grooves 101, 102, 103 and 104 surround opening 92 and relieve the gas pressure on the outside face of segment sealing member 91. The grooves 101–104 surround a rectangular land or ridge 105 that is located in sealing engagement with the inner surface 37 of sleeve 33. Sealing member 91 has side wall relieve portions 106 and 107, and top and bottom relieved wall portions 108 and 109, as shown in FIGS. 5 and 11, spaced from surface 37 of the sleeve to reduce friction and allow for thermal expansion of the metal of sealing member 91.

Figure 12:
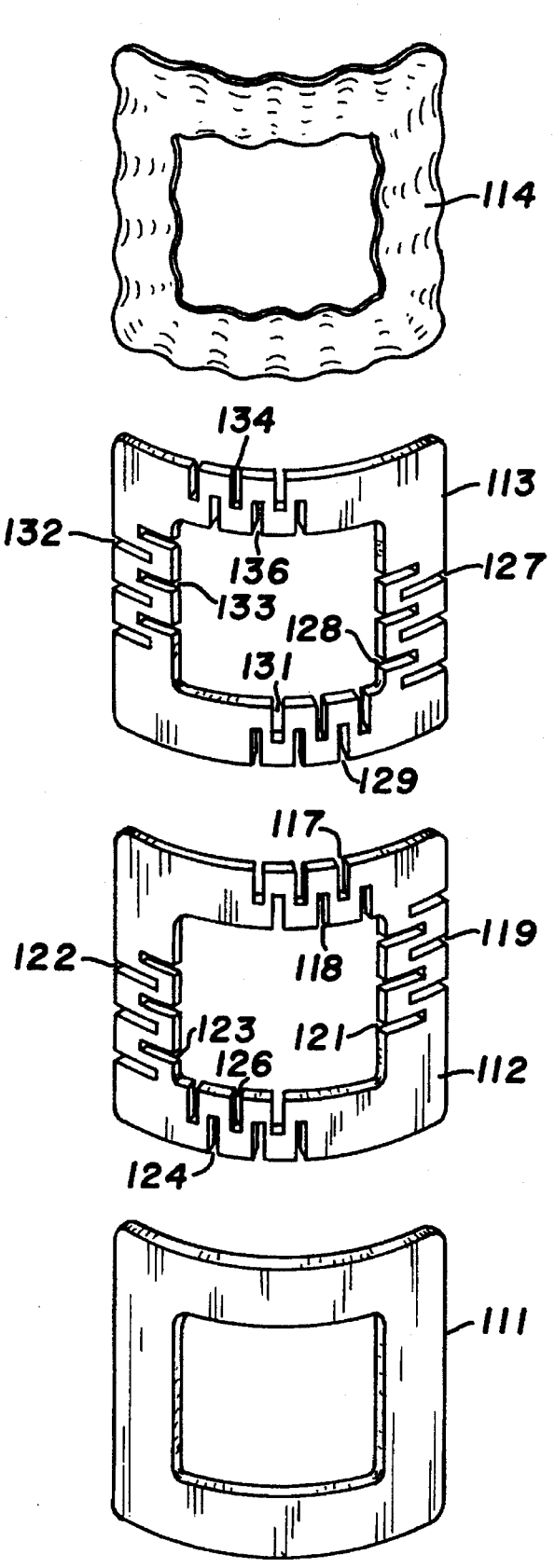
FIG. 12 is an exploded perspective view of the intake seal assembly.

Box sealing member 91 is biased outwardly with a generally rectangular serpentine spring washer 114. Other types of rectangular springs can be used to bias segment sealing member 91 in an outward direction to accommodate for wear of sealing member 91. As seen in FIGS. 11 and 12, washer 114 is located behind a solid box ring 111 and split or flexible box washers or seals 112 and 113 located in a counter-sunk recess 116 surrounding the side wall opening of combustion chamber 39. The spring washer 114, ring 111 and flexible box washers 112 and 113 each have a radial length to substantially fill recess 116 to reduce spaced that collect gases and carbons. The detailed construction of box rings 111, 112 and 113 and spring 114 are shown in FIG. 12. Ring 111 is an arcuate segment with rectangular construction with an outer curved surface that is positioned in surface engagement with the inside surface of segment sealing member 91. Washer 112 has a series of inwardly and outwardly directed slits 117, 118, 119 and 121 in the upper right hand corner thereof. Similar slits 122, 123, 124 and 126 are located in the lower left hand corner thereof. Washer 113 has inwardly and outwardly directed slits in the corner sections thereof opposite the corner sections of the washer 112 having the slits. Slits 127, 128, 129 and 131 are located in the lower left hand corner of washer 113. Slits 132, 133,134 and 136 are located in the upper left hand corner of washer 113. The slits on adjacent washers 113 and 114 are laterally spaced to maintain sealing effectiveness. The flexible washers 113 and 114 allow for thermal expansion as they are laterally flexible and rigid in the axial direction. The slits allow washers 113 and 114 to have limited vertical and circumferential or outward expansion without effecting the face-to-face sealing functions between the washers and ring. Spring washer 114 is a generally rectangular curved member having generally serpentine curved walls which function as a spring that biases the segment sealing member 91 in an outward direction into surface sealing engagement with the inside surface 37 of sleeve 33.

Referring to FIGS. 8 and 9, an arcuate band 137 surrounds the outside of the body of valve 138 between the opposite side edges of segment sealing member 91. Band 137 has an inwardly directed projection 138 extended into a groove 139 into the body of valve 38. Other structures, such as a pin, can be used to anchor band 137 to valve 38. Band 137 substantially fills the annular space 141 between the inside wall 37 of sleeve 28 and the outer circumferential wall 140 of valve 38. Band 137 reduces the open space around the body of valve 38 in which gases and particulates can collect. Space 141 allows for thermal growth of the metals of valve 38 and sleeve 33 and prevents friction losses as the body of valve 38 does not contact sleeve 33.

Figure 13:
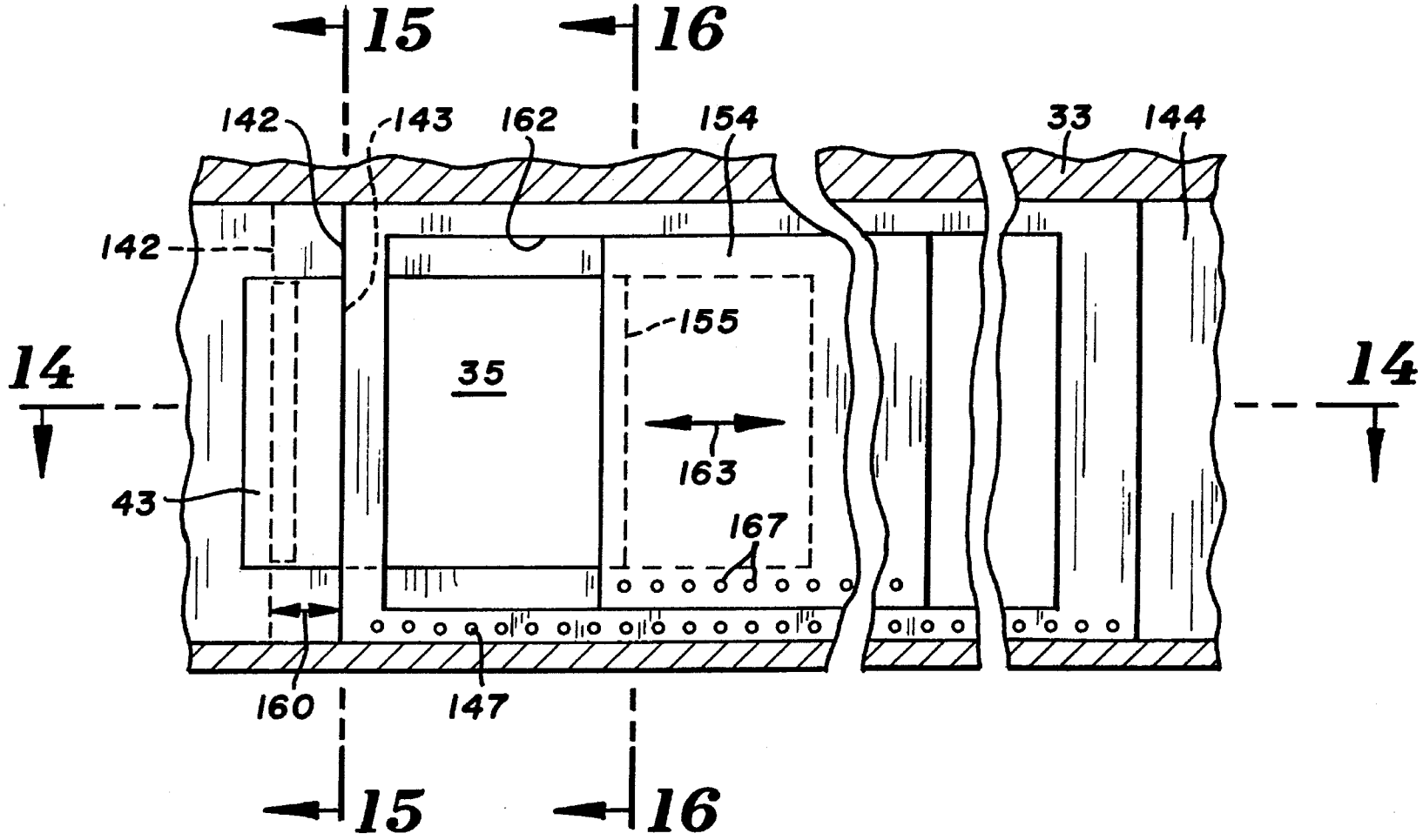
FIG. 13 is an enlarged sectional view taken along the line 13—13 of FIG. 9.
Figure 14:
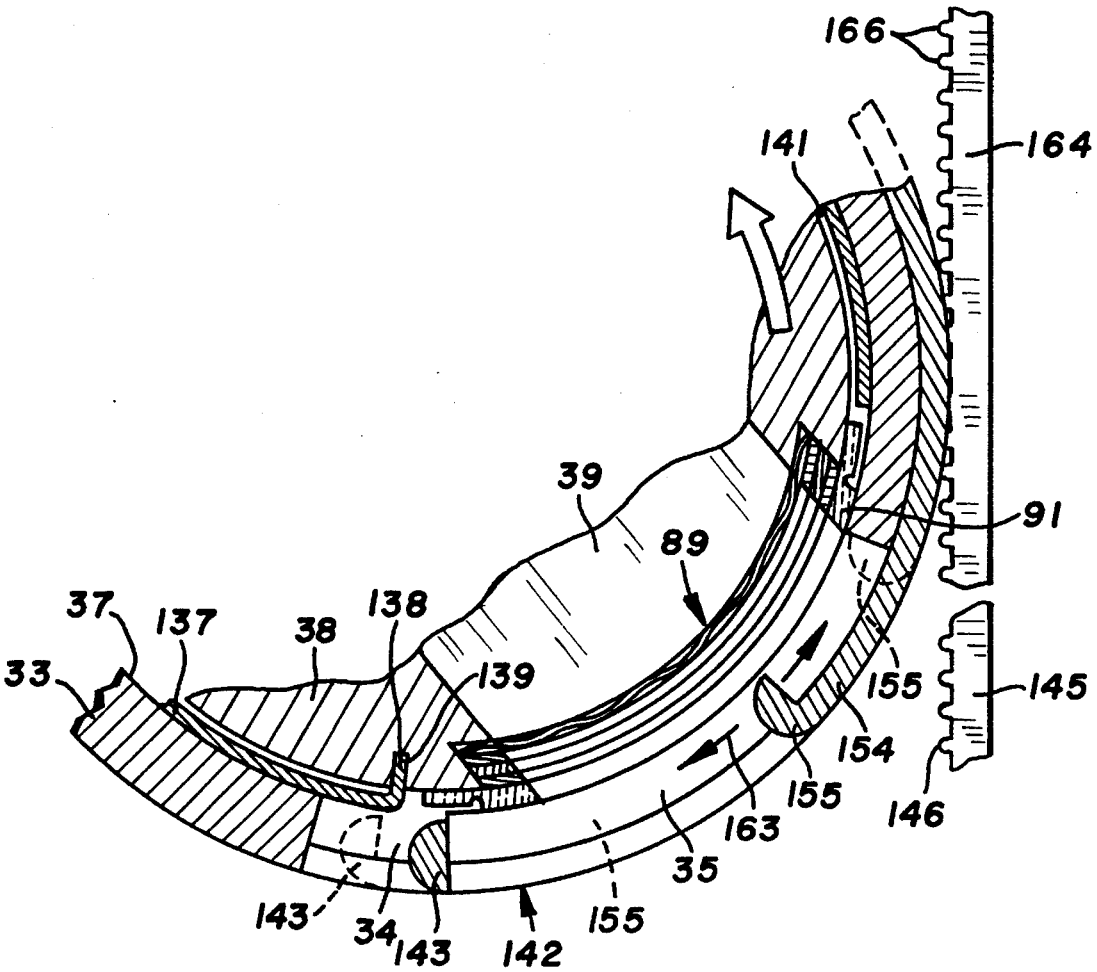
FIG. 14 is a sectional view taken along the line 14—14 of FIG. 13, showing the range of movement of the primary and secondary structures providing variable intake valve timing.
Figure 15:
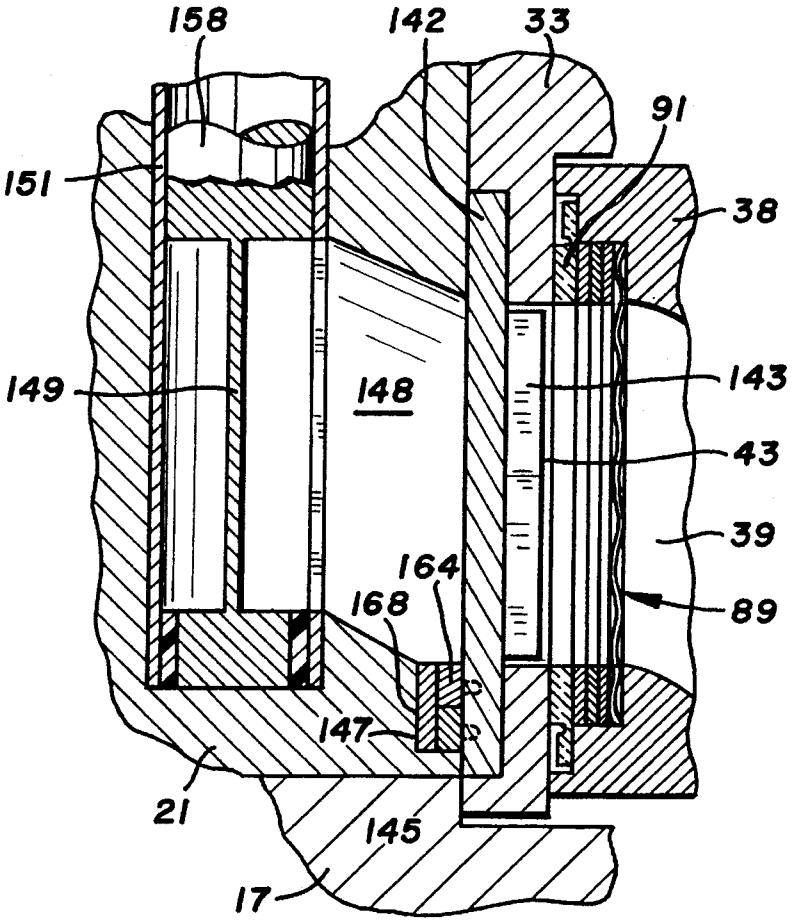
FIG. 15 is a sectional view taken along the line 15—15 of FIG. 14.

As seen in FIGS. 8, 9 and 13, a primary shutter 142 has an inwardly directed lip 143 extended into intake port section 34 terminating close to segment sealing member 91. As shown in Figure 15, lip 143 extends to the top and bottom edges of port section 34. Shutter 142 is an arcuate member slidably located in a circumferential groove or channel 144 in the outside of sleeve 33. Shutter 142 is circumferentially movably on sleeve 33 between a full open position shown in broken lines to change the area of inlet port section 34 thereby controlling the flow and timing of the air/fuel mixture into the combustion chamber and resultant speed of the engine. A first actuator rod 145, having teeth 146 cooperating with holes 147 in shutter 143, is movable to adjust the position of shutter 142 relative to inlet port section 34. Rod 145 is slidably located in a longitudinal bore 147 in head 21 so that longitudinal movement of rod 145 will circumferentially move shutter 142. The controls for moving rod 145 are hereinafter described.

Figure 19:
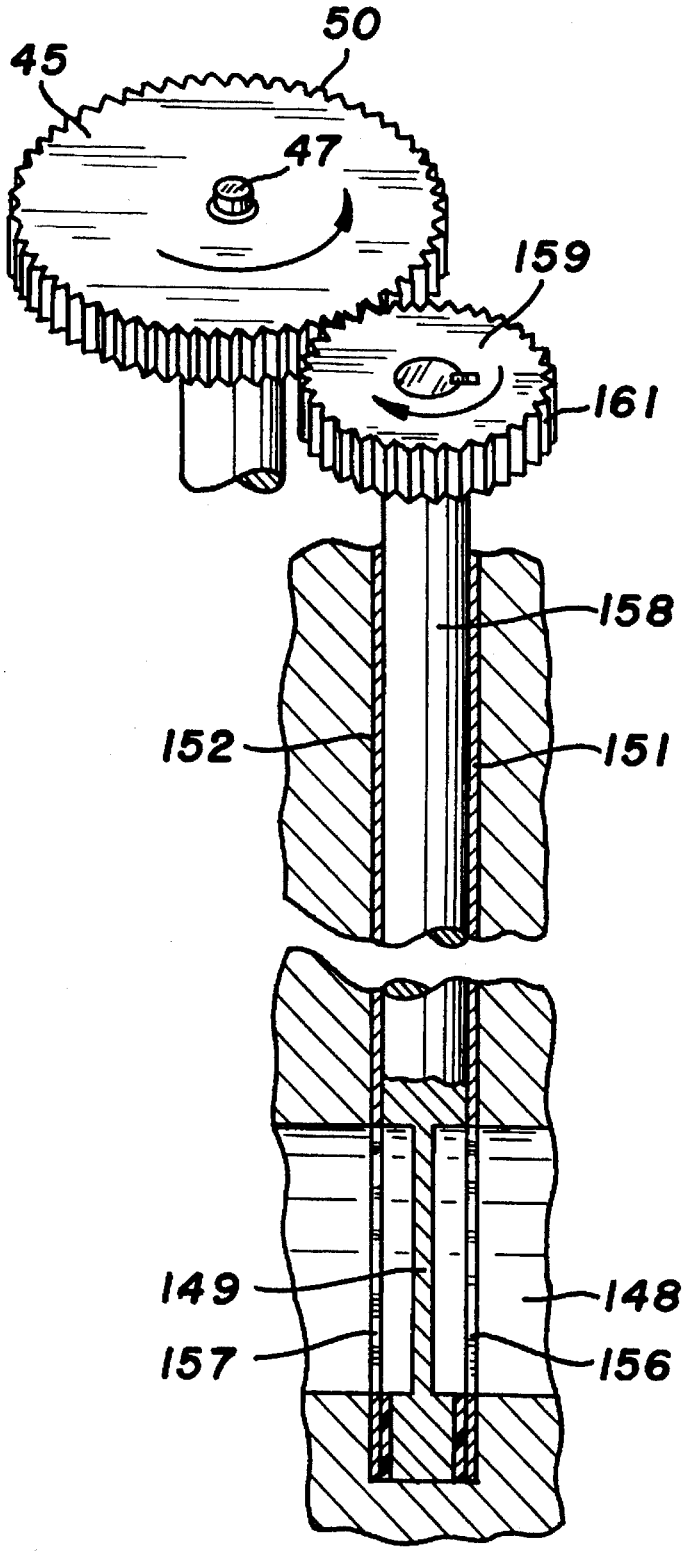
FIG. 19 is a perspective view of the auxiliary valve drive and valve.

As shown in FIG. 8, a combustible air/fuel mixture flows through a passage 148 in head 21 from inlet opening to inlet port section 34. At idle and part load speeds, the intake port section 35 is closed with a secondary shutter 154. The air/fuel mixture flows through passage 148, indicated by arrows 153, and is controlled with an auxiliary valve or gate 149. Gate 149 is a generally flat blade rotatably located in a tubular sleeve 151. Other types of valves, such as a reed valve, can be used as a gate. Sleeve 151 is positioned in an upright bore in head 21. Sleeve 151 has opposite openings 156 and 157 aligned with passage 148 to allow the air/fuel mixture to flow past gate 149 when it is in the open position, as seen in FIG. 8. As shown in FIG. 19, gate 149 is part of an upright shaft 158 rotatably located in tubular sleeve 151. A spur gear 159 attached to the upper end of shaft 158 has teeth 161 in drive engagement with teeth 50 on cap 50 whereby gate 149 is rotated in timed relation with valve 38. Gate 149 is rotated at twice the speed of valve 38 or at the same speed of rotation of crank shaft 14. As shown in FIG. 8, valve 38 has closed exhaust port 36. The piston 13 is about 18–20 degrees before top dead center and gate 149 is open to allow the air/fuel mixture to flow through passage 148 into combustion chamber 39. The air/fuel mixture will continue to flow into combustion chamber 39 until the trailing edge of combustion chamber 39 moves past lip 143 of shutter 142.

Figure 16:
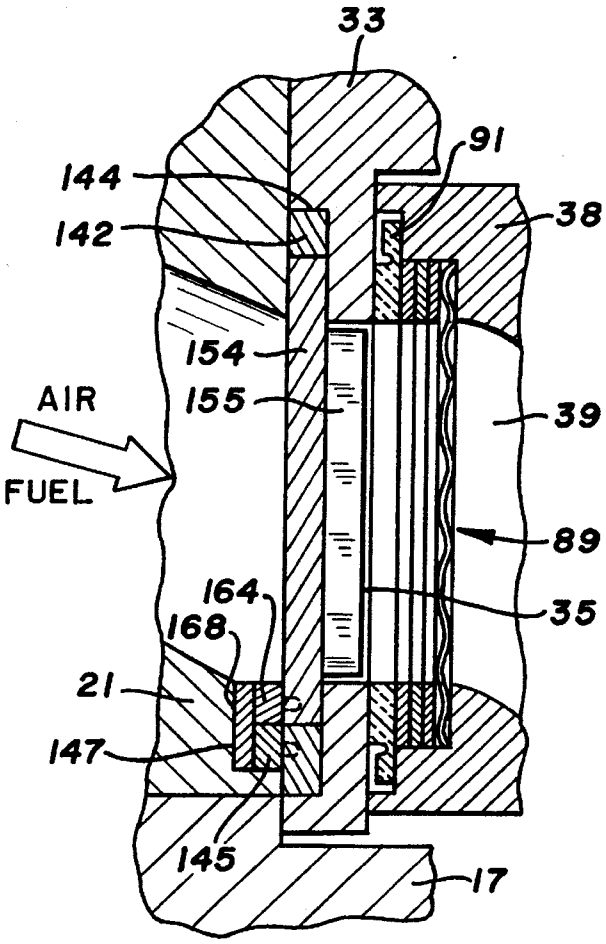
FIG. 16 is a sectional view taken along the line 16—16 of FIG. 14.

As shown in FIG. 13, shutter 142 has an elongated window 162 partly closed with a secondary shutter 154 located within window 162 and movably mounted on the outside of sleeve 33. Shutter 154 has an inwardly directed lip 155 terminating in an edge close to sealing member 91. As shown in FIG. 16, lip 155 extends between the top and bottom edges of port 35. Shutter 154 is selectively movable in opposite directions, as indicated by arrow 163, to alter the size of the opening to intake port 35 between a closed position to a full open position, as shown in full and broken lines in FIG. 8. Shutter 154 also changes the valve closing timing of valve 38. A second actuator rod 164, having teeth 166 cooperating with holes 167 along the bottom portion of shutter 154, is operable to selectively adjust the position of shutter 154 to change the size of the opening to intake port section 35 and cut off timing of air/fuel flow into combustion chamber 39. This regulates the amount of the air/fuel mixture that flows into combustion chamber 39 thereby controlling the speed of the engine. Shutter 154 is moved with a second actuator rod 164 having teeth 166 cooperating with holes 167 along the bottom portion of shutter 154. Actuator rods 145 and 164 are operated with a control mechanism 169, shown in FIG. 17.

Shutters 142 and 154 provides flexibility in the scheduling of the valve inlet timing events throughout the engines' load speed ranges. This is variable valve timing of the closing of the inlet valving of the engine. The variable valve timing capability reduces pumping or parasitic losses as the intake and exhaust gas pressures are substantially the same under all operation conditions. Fuel economy gains are achieved by the reduction of the pumping losses which are present in an internal combustion engine having a throttle to control intake air and fuel flow.

Control mechanism 169 has a progressive motion control 171 connected to actuator rods 145 and 164 and a linkage 172 connected to a foot operated lever 173. A coil spring 174 interposed in linkage 172 provides a biasing coupling between control 171 and lever 173 which limits operation of the control to achieve engine operating efficiency over the range of load and speed of the engine. Lever 173 is mounted on a pivot 176 and biased with a tension spring 177 to an idle position.

Control mechanism 169 has a finger 178 adjustably mounted on linkage 172 and engageable with a movable stop 179. A rack 181 attached to stop 179 is moved with a gear 182 coupled to a stepping motor 183. Motor 183 is operable to selectively move rack 181 in opposite directions to change the position of stop 179 proportional to the maximum torque output of the engine at each engine RPM. Motor 183 is a reversible D.C. electric motor controlled with a micro processor 184. An RPM sensor 186, responsive to the RPM of the engine, provides the micro processor 184 with information signals used by the program. included in the micro processor 184 to change the position of stop 179 to tailor the timing of the intake valve closing to the optimum point for each engine speed to achieve volumetric efficiency and reductions in fuel consumption.

Figure 18:
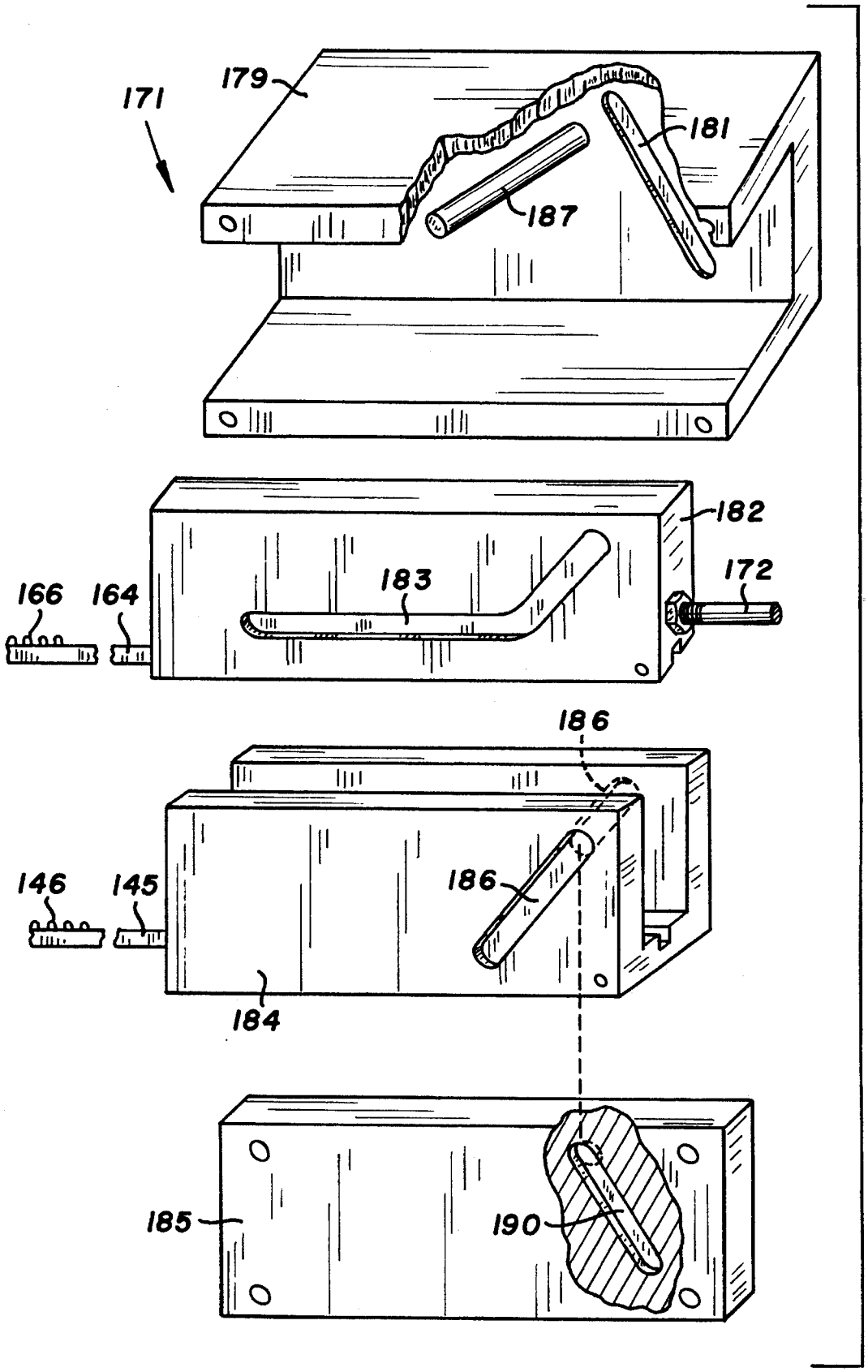
FIG. 18 is an exploded perspective view of the mechanical progressive motion control for the primary and secondary shutters.

Referring to FIG. 18, the progressive motion control 171 for the actuator rods 145 and 164 is connected to linkage 172 under the control of foot lever 173. Motion control 171 has a fixed U-shaped housing 179 with an upwardly directed inclined slot 181 in its back wall. A first plate 182, located within housing 179, is longitudinally movable with linkage 172. Plate 182 has an obtuse angle slot 183 having a longitudinal portion and an upwardly and outwardly inclined portion that is opposite the inclination of slot 181. The bottom of plate 182 has a groove accommodating rod 164. Rod 164 is attached to plate 182 so that movement of plate 182 results in movement of rod 164 and secondary shutter 154. A channel or U-shaped member 184, having side flanges with upwardly and outwardly inclined slots 186, is located within housing 179. Plate 182 fits between the side flanges of channel member 184. The bottom of channel 184 has a groove accommodating rod 145. Rod 145 is attached to channel member 184 so that movement of channel member 184 results in movement of rod 145 and primary shutter 154. A side plate 185, having an inclined slot 190, is secured to the open side of housing 179 to retain channel member 184 and plate 182 within housing 179. Slot 190 is aligned with and has the same inclination as slot 181 in the back of housing 179. A pin 187 extends through slots 183 and 186 and projects into slots 181 and 190.

Figure 17:
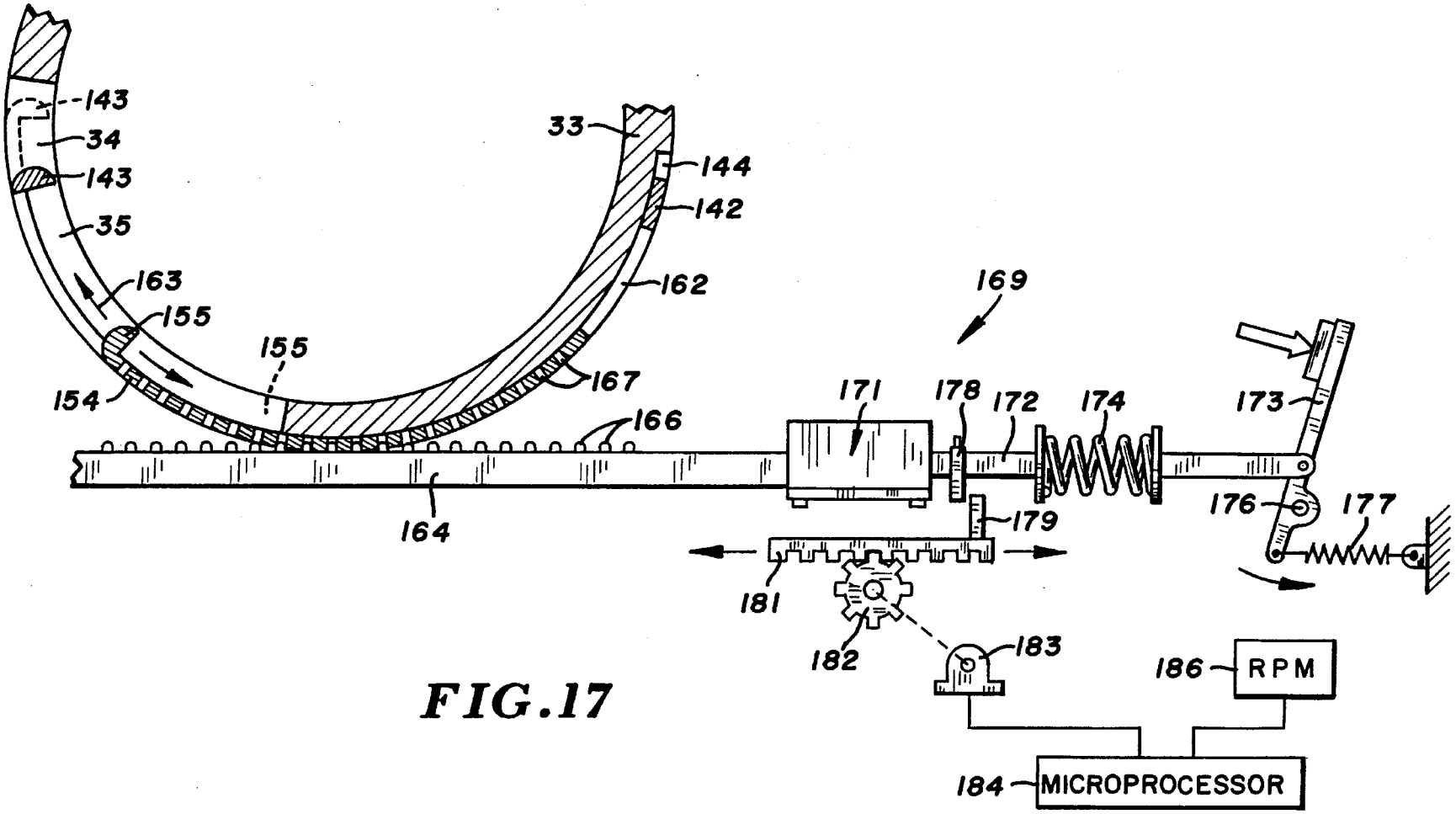
FIG. 17 is an enlarged sectional view taken along the line 15—15 of FIG. 5 and a diagrammatic view of the control mechanism for the primary and secondary shutters.

In use, plate 182 and channel member 184 moves the primary shutter 149 and secondary shutter 154 together so that the primary shutter moves between the idle position and its full, open position, as shown by arrows 160 in FIG. 13. This is achieved without opening secondary shutter 154. Pin 187 moves down incline slots 183 and 186 and slots 181 and 190, causing both plate 182 and channel member 184 to move together so that both rods 145 and 164 simultaneously move both shutters 142 and 154 when linkage 172 is moved by operation of foot lever 173. When additional speed is requested, the foot operated pedal 173 is depressed, causing the linkage 172 to move plate 182, thereby moving actuator rod 164 to open secondary shutter 154. Pin 187 is located in the horizontal portions of slot 183 so that plate 182 moves relative to channel member 184 whereby only rod 164 moves to open secondary shutter 154. When the pressure on foot pedal 173 is released, the spring 177 moves motion control 171 back to the idle position wherein the secondary shutter 154 is closed and the primary shutter is moved to its initial idle position. As shown in FIG. 17, the stop 179 is adjustable by the operation of stepping motor 183. Micro processor 184 provides the electrical signals to stepping motor 183 to operate the stepping motor selectively in opposite directions to vary the position of stop 179 in accordance with the optimum engine operating conditions in accordance with the RPM of the engine. When force is applied to foot lever 173, spring 174 biases finger 178 into engagement with stop 179. Movement of linkage 172 is then controlled by movement of stop 179 so that maximum torque at each RPM is achieved by the engine.

Figure 20:
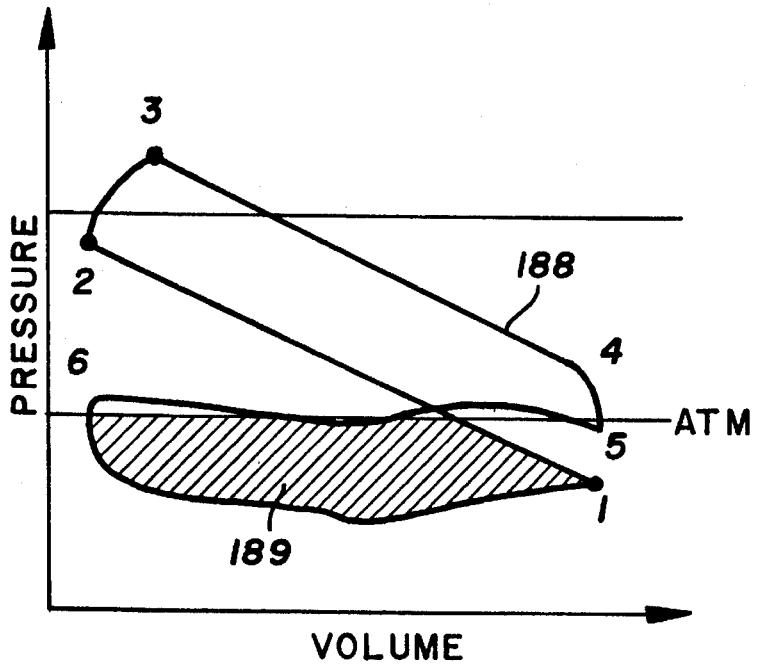
FIG. 20 is a pressure volume diagram of an internal combustion engine having rotary valve assemblies and a conventional throttle.

Referring to FIG. 20, there is shown a part load pressure volume diagram 188 for a standard otto cycle internal combustion engine having rotary valves and a conventional throttle. The cycle consists of:

1–2 Isentropic compression,

2–3 Constant volume energy addition,

3–4 Isentropic expansion,

4–5 Constant volume energy rejection,

5–6 The exhaust stroke, and

6–1 The intake stroke.

During throttled operation, the cylinder pressure falls below atmospheric during the intake stroke by an amount determined by the throttle setting. The amount of positive work associated with the intake stroke is less than the negative exhaust work. There is a negative effect which causes the throttled engine to be less efficient. The negative network is represented by the cross hatch portion 189 in pressure volume diagram 188. The negative work is the pumping loss attributed to throttle operation. This pumping loss is substantially reduced with the intake valve timing shutters 142 and 154 of the invention.

Figure 21:
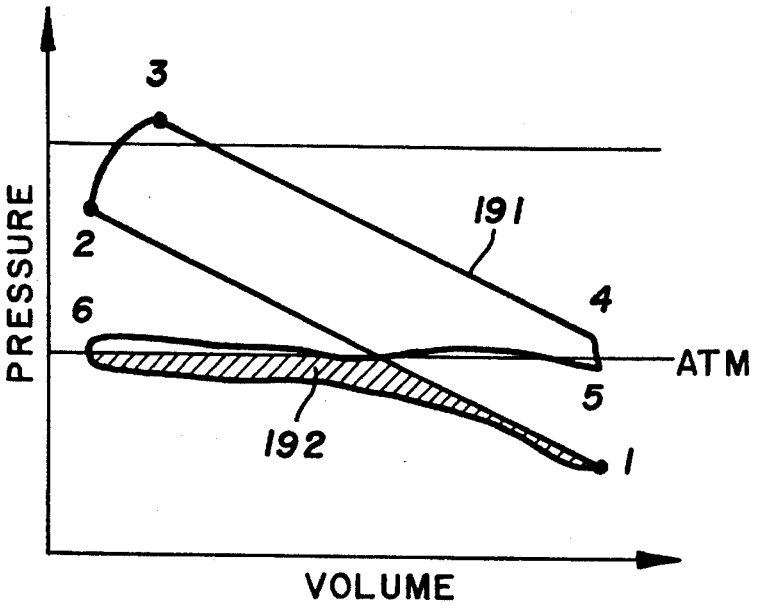
FIG. 21 is a pressure volume diagram of the internal combustion engine having the rotary valve assemblies with variable valve timing of the invention.

FIG. 21 is a pressure volume diagram 191 that represents the improved operation cycle of an engine under part load having the rotary valve assemblies and variable valve timing of the invention. The negative effect or pumping loss indicated by the shaded portion 192 of the pressure volume diagram is substantially less than the pumping loss, as shown in FIG. 17. Shutters 142 and 154 accomplished a variation of intake valve closure from 50 degrees to 250 degrees after top dead center. This broad range of variability achieves efficient power control from idle to full power. The control 169 for movable shutters 142 and 154 have the ability to tailor the timing of the intake valve closing to the optimum point for each respective engine speed.

Figure 3:
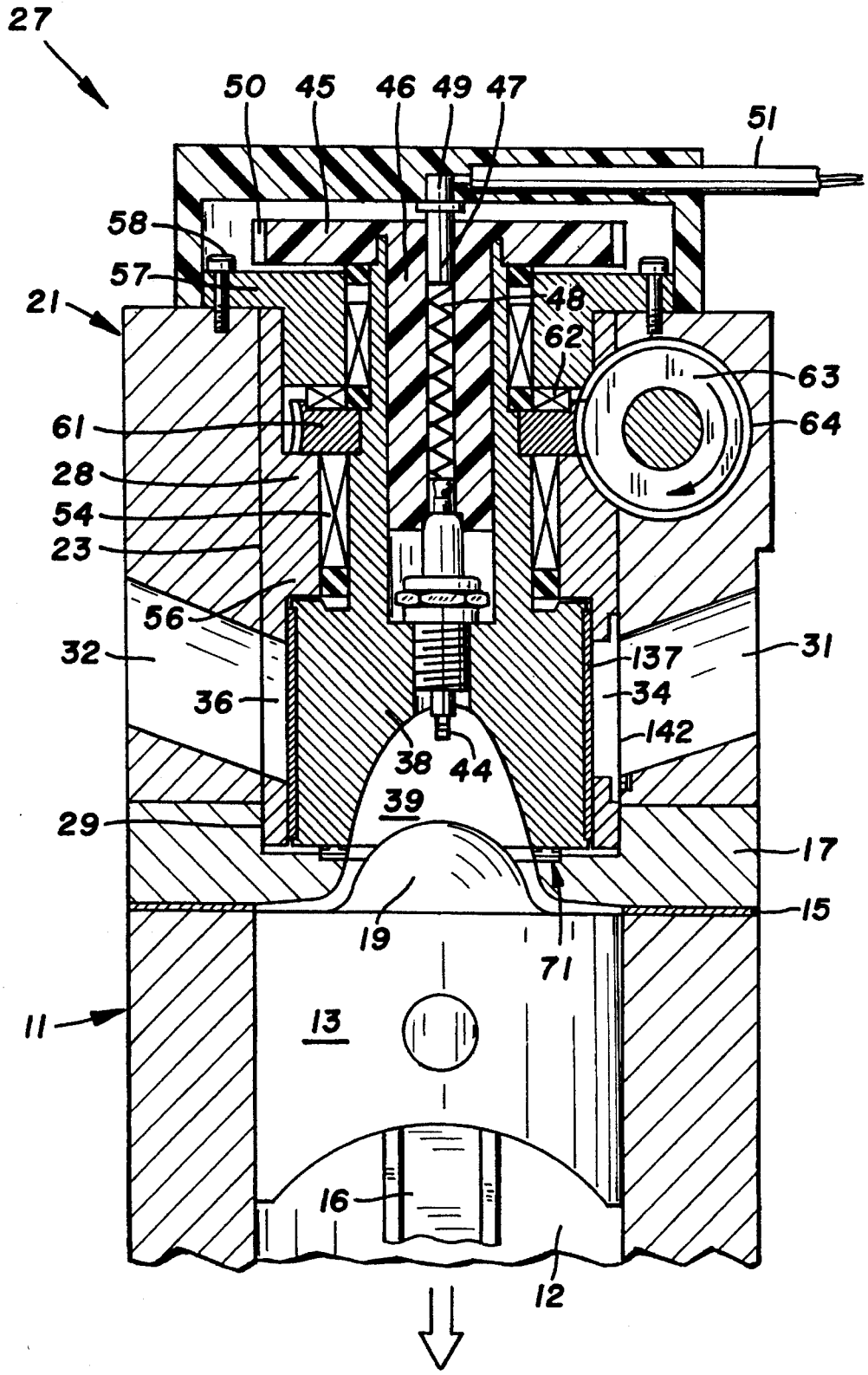
FIG. 3 is a sectional view similar to FIG. 2 showing the rotary valve in the power stroke position with the piston at head dead center.
Figure 4:
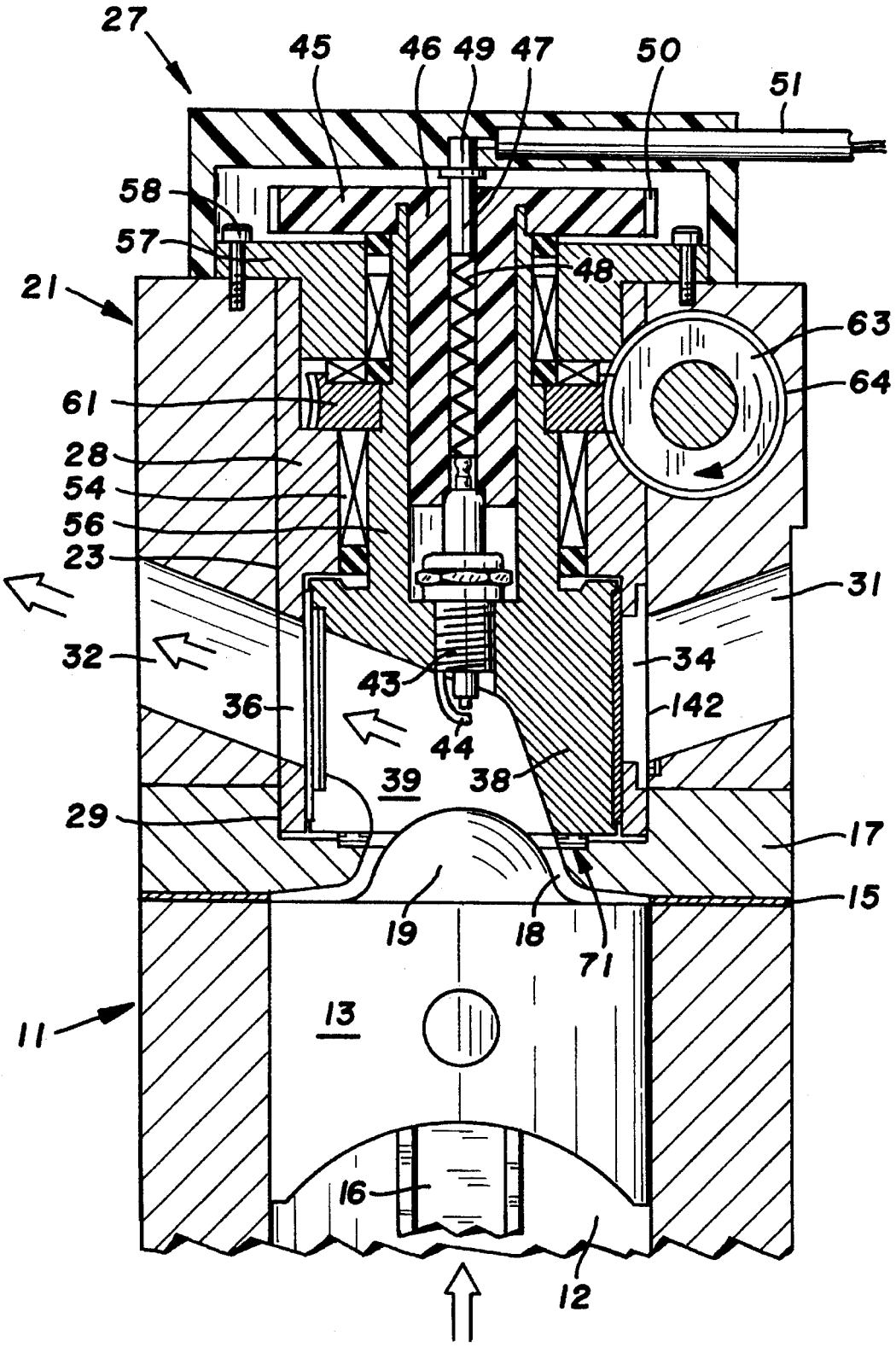
FIG. 4 is a sectional view similar to FIG. 2 showing the rotary valve in the exhaust stroke position with the piston at head dead center.

In use, the intake and exhaust manifolds operate at or near atmospheric pressure under all load conditions. There is no significant gas pressure difference in either the cylinder or the exhaust port 32 or the exhaust manifold as compared to the intake port 31 and manifold gas pressure. The result is that there is little impetus for residual gases to back-flow into the intake manifold or for exhaust gases to flow back into combustion chamber 39 and cylinder 12. The primary movable shutter 142 varies the intake valve closing between idle and part load operating conditions. Lip 143 on shutter 142 is moved clockwise to cause earlier valve closing and move counter-clockwise to delay the valve closing event. This is accomplished by the motion control mechanism 171 which is operated by foot lever 173. Engine 10 is initially in an idle condition. The foot lever 173 is depressed to move the primary shutter 142 to an open position. As shown in FIG. 8, the lip 143 moves from the idle broken line position to the full line position. When the valve 38 is in the position immediately after the completion of the exhaust cycle, as shown in FIG. 8, the auxiliary valve 149 is open allowing the air/fuel to flow through passage 148, port 34 into combustion chamber 39. The secondary shutter 154 is closed as the engine is between idle and part load operating conditions. The air/fuel mixture commences to flow into the combustion chamber at about 18 degrees before the piston reaches head dead center. When the piston reaches head dead center as shown in FIG. 9, the valve port 34 is closed and the combustion chamber 139 is lined with the valve port 35, as seen in FIG. 9. If additional speed of the engine is required, the secondary shutter 154 is moved to an open position, as shown in FIG. 9, thereby allowing additional air/fuel mixture to flow into combustion chamber 39. The valve 38 continues to rotate in a counter clockwise direction, as indicated by the arrow, through the compression cycle and expansion cycle. The expansion of power cycle is shown in FIG. 3. Both the intake port 34 and exhaust port 36 are closed. The arcuate sealing member 91 is located about midway between the intake port segments 34 and 36. FIG. 4 shows the position of the valve 38 with the combustion chamber 39 aligned with the exhaust port 36 wherein the exhaust gases are expelled from the engine. The auxiliary valve 149 is closed during the exhaust cycle to prevent blow-back of exhaust gases into the inlet passage 31. As soon as the exhaust cycle is completed, the intake cycle is commenced.

As shown in FIG. 21, there is a substantial reduction in the pumping losses with the use of variable movable shutters 142 and 154 immediately adjacent the inlet to combustion chamber 39 of the valve 38. The flame initiation period and the main burn duration under part load operation of the engine equipped with the variable movable shutter 142 are substantially shorter than with conventional throttled rotary valve engines. The reduced burn duration is predicated on the location of shutter 142 immediately adjacent the inlet to combustion chamber 39 of valve 38. Fast burning is produced by the rapid cylinder in flow of air and fuel. The timing of the air/fuel induction is altered such that the mass flow is concentrated into a shorter pulse of high flow over a short period rather than a low flow rate occurring over an extended period. The kinetic energy initially put into the in cylinder flow field results in shorter ignition delays and faster combustion. Valve 38, variable movable shutters 142 and 154 and control 169 for shutters 142 and 154 are vibration free and tolerant of brittle or low tensile strength advanced engineering materials. The tailoring of the timing of the intake valve closing to the optimum point for each respective engine speed results in a volumetric efficiency and corresponding reductions in fuel consumption. Alternative combustible fuels, such as gasoline and ethanol, can be used as the effective compression ratio of the engine and can be altered with variable valve timing. This reduces detonation of the air/fuel mixture during the compression cycle of the engine.

While there has been shown and described a preferred embodiment of the rotary valve assembly having variable intake valve timing of the invention, it is understood that changes in the structures, arrangements of the structures and seals used with the valve assembly may be made by those skilled in the art without departing from the invention. The invention is defined in the following claims.

We claim:

1. An internal combustion engine comprising: a block having cylindrical wall means surrounding at least one piston chamber, piston means located in said piston chamber, means operable to reciprocate the piston means in said chamber, a head plate located on the block over the piston chamber, said head plate having an opening in communication with said chamber, head means mounted on the head plate, means securing the head means and head plate to the block, said head means having an upright bore, air/fuel intake and exhaust gas passages open to said bore, a cylindrical sleeve located within said bore, said sleeve having an inside cylindrical surface surrounding a valve chamber, a first air/fuel intake port section open to the intake passage and a second air/fuel intake port section open to the intake passage, and an exhaust gas port circumferentially spaced from the intake ports open to the exhaust gas passage, rotary valve means located in said valve chamber having a valve combustion chamber continuously open to the opening in the head plate and sequentially open to the first and second air/fuel intake port sections and exhaust gas port for controlling the flow of air/fuel mixture into the valve combustion chamber and the flow of exhaust gas from the valve combustion chamber and piston chamber, said sleeve having an outer surface with a circumferential groove extended over the air/fuel intake port sections, shutter means located in said groove providing separate openings between the air/fuel intake passage and the first and second air/fuel intake port sections, means for moving the shutter means relative to the sleeve to vary the size of the openings and vary the timing of the closing of the air/fuel intake port sections, first seal means mounted on the head plate engageable with the valve means to block flow of gas into the valve combustion chamber between the valve means and the sleeve, second seal means mounted on the valve means to block flow of gas into the valve combustion chamber between the valve means and the sleeve, and means operable to rotate the valve means in timed relation with the movement of the piston means whereby the engine has intake, compression, power and exhaust strokes.

2. The engine of claim 1 wherein: said head has an idle and part load passage for the air/fuel mixture between the intake gas passage and the first intake port section, gate means located in said idle and part load passage for controlling the flow of air/fuel mixture to said first intake port section, and means for operating the gate means in timed relation with the rotation of the valve means whereby the gate means is closed during the flow of exhaust gas from the valve combustion chamber and open to allow flow of the air/fuel mixture into the valve combustion chamber.

3. The engine of claim 2 wherein: the gate means is a valve located in said idle and part load passage, said means for operating the gate means comprise drive means connecting the rotary valve means with the valve whereby the valve is operated in timed relation with the rotary valve means.

4. The engine of claim 1 wherein: said shutter means comprises a first shutter operable to selectively vary the size of the opening to the first air/fuel port section and timing of the closing thereof, and a second shutter operable to selectively vary the size of the opening to the second air/fuel port section and timing of the closing thereof, and said means for moving the shutter means including a first control means for selectively moving the first shutter and a second control means for moving the second shutter and means for operating the first and second control means.

5. The engine of claim 4 wherein: the first shutter has a lip projected into the first intake port section, and the second shutter has a lip projected into the second intake port section.

6. The engine of claim 1 wherein: said valve means has a valve body having an outside cylindrical surface spaced inwardly from the inside cylindrical surface of the sleeve, an arcuate band located in the space between the valve body and sleeve, said band having opposite ends on opposite sides of the second seal means, means connecting the band to said body whereby said band rotates with said body, said second seal means having a segment seal member located between the opposite ends of the band, said segment seal member having land means located in sliding sealing engagement with the inside cylindrical surface of the sleeve.

7. The engine of claim 1 wherein: the first seal means has members subjected to opposite gas pressure forces to negate the effect of the gas pressure in the valve chamber, and biasing means to bias one of the members in sliding sealing engagement with the valve means.

8. The engine of claim 7 wherein: said head plate has a cylindrical recess accommodating a lower portion of the sleeve, said members and biasing means being located in said recess.

9. The engine of claim 8 wherein: said head plate has outwardly directed pockets open to said recess, said one of the members having ears extended into said pockets to prevent rotation of said one of the members.

10. The engine of claim 1 wherein: the first seal means has an annular member spaced below the valve means, said member having an annular rib located in sliding sealing contact with the valve means inwardly of an inner portion of the annular member whereby gas pressure in the valve chamber applies force on the annular member away from the valve means, ring means located below the annular member, and biasing means forcing the ring means into engagement with ring means and holding the rib in sealing contact with the valve means, said gas pressure in the valve chamber acting on the ring means to balance the force of the gas pressure on the annular member.

11. The engine of claim 10 wherein: said head means has outwardly directed pockets located adjacent the annular member, said annular member having ears extended into said pockets to prevent rotation of said annular member.

12. The engine of claim 1 wherein: said valve means has a valve body having said combustion chamber, a recess in said body for accommodating the second seal means, said second seal means including an arcuate seal member engageable with the inside surface of the sleeve, a plurality of box seals located in said recess, at least one of the box seals having a body with inwardly and outwardly directed slits, and spring means located in said recess engageable with a box seal to bias the arcuate seal member into engagement with the inside surface of the sleeve.

13. An internal combustion engine comprising: a block having cylindrical wall means surrounding at least one piston chamber, piston means located in said piston chamber, means operable to reciprocate the piston means in said chamber, head means connected to the block, said head means having a bore open to the piston chamber, air/fuel intake and exhaust gas passages open to said bore, a cylindrical sleeve located within said bore, said sleeve having an inside cylindrical surface surrounding a valve chamber, a first air/fuel intake port section open to the intake passage and a second air/fuel intake port section open to the intake passage, and an exhaust gas port circumferentially spaced from the intake port sections open to the exhaust gas passage, rotary valve means located in said valve chamber having a valve combustion chamber continuously open to the opening in the piston chamber and sequentially open to the first and second air/fuel intake port sections and exhaust gas port for controlling the flow of air/fuel mixture into the valve combustion chamber and the flow of exhaust gas from the valve combustion chamber and piston chamber, said sleeve having an outer surface with a circumferential groove extended over the air/fuel intake port sections, shutter means located in said groove providing separate openings between the air/fuel intake passage and the first and second air/fuel intake port sections, means for moving the shutter means relative to the sleeve to vary the size of the openings and vary the timing of the closing of the air/fuel intake port sections, and means operable to rotate the valve means in timed relation with the movement of the piston means whereby the engine has intake, compression, power and exhaust strokes.

14. The engine of claim 13 wherein: said head has an idle and part load passage for the air/fuel mixture between the intake gas passage and the first intake port section, gate means located in said idle and part load passage for controlling the flow of air/fuel mixture to said first intake port section, and means for operating the gate means in timed relation with the rotation of the valve means whereby the gate means is closed during the flow of exhaust gas from the valve chamber and open to allow flow of the air/fuel mixture into the valve chamber.

15. The engine of claim 14 wherein: the gate means is a valve located in said idle and part load passage, said means for operating the gate means comprise drive means connecting the rotary valve means with the valve whereby the valve is operated in timed relation with the rotary valve means.

16. The engine of claim 13 wherein: said shutter means comprises a first shutter operable to selectively vary the size of the opening to the first air/fuel port section and timing of the closing thereof, and a second shutter operable to selectively vary the size of the opening to the second air/fuel port section and timing of the closing thereof, and said means for moving the shutter means including a first control means for selectively moving the first shutter and a second control means for moving the second shutter and means for operating the first and second control means.

17. The engine of claim 13 wherein: the first shutter has a lip projected into the first intake port section, and the second shutter has a lip projected into the second intake port section.

18. The engine of claim 13 wherein: said valve means has a valve body having an outside cylindrical surface spaced inwardly from the inside cylindrical surface of the sleeve, an arcuate band located in said space, and means connecting the band to said valve body whereby the band rotates with the valve body.

19. An internal combustion engine comprising: a block having cylindrical wall means surrounding at least one piston chamber, piston means located in said piston chamber, means operable to reciprocate the piston means in said chamber, a head plate located on the block over the piston chamber, said head plate having an opening in communication with said chamber, head means mounted on the head plate, means securing the head means and head plate to the block, said head means having an upright bore, air/fuel intake and exhaust gas passages open to said bore, a cylindrical sleeve located within said bore, said sleeve having an inside cylindrical surface surrounding a valve chamber, an air/fuel intake port open to the intake passage, and an exhaust gas port circumferentially spaced from the intake port open to the exhaust gas passage, rotary valve means located in said valve chamber having a valve combustion chamber continuously open to the opening in the head plate and sequentially open to the air/fuel intake port and exhaust gas port for controlling the flow of air/fuel mixture into the valve combustion chamber and the flow of exhaust gas from the valve combustion chamber and piston chamber, said sleeve having an outer surface with a circumferential groove extended over the air/fuel intake port, shutter means located in said groove providing an opening between the air/fuel intake passage and the air/fuel intake port, means for moving the shutter means relative to the sleeve to vary the size of the opening and vary the timing of the closing of the air/fuel intake port, first seal means mounted on the head plate engageable with the valve means mounted on the head plate engageable with the valve means to block flow of gas into the valve combustion chamber between the valve means and the sleeve, second seal means mounted on the valve means to block flow of gas into the valve chamber between the valve means and the sleeve, and means operable to rotate the valve means in timed relation with the movement of the piston means whereby the engine has intake, compression, power and exhaust strokes.

20. The engine of claim 19 wherein: the shutter means includes a lip projected into the intake port.

21. The engine of claim 19 wherein: the shutter means is an arcuate member having a transverse lip on the forward end thereof projected into the intake port.

22. The engine of claim 19 wherein: the means for moving the shutter means includes an elongated actuator rod, cooperating means coupling the rod to the shutter means whereby movement of the rod moves the shutter means to vary the size of the opening and vary the timing of the closing of the air/fuel intake port, and control means for moving the rod thereby changing the speed of the engine.

23. The engine of claim 22 wherein: the control means includes a foot-operated lever and linkage means connecting the lever to the rod whereby movement of the lever results in proportional movement of the rod and shutter means.

24. The engine of claim 19 wherein: said valve means has a valve body having an outside cylindrical surface spaced inwardly from the inside cylindrical surface of the sleeve, an arcuate band located in the space between the valve body and sleeve, said band having opposite ends on opposite sides of the second seal means, means connecting the band to said body whereby said band rotates with said body, said second seal means having an arcuate seal member located between the opposite ends of the band, said arcuate seal member having land means located in sliding sealing engagement with the inside cylindrical surface of the sleeve.

25. The engine of claim 19 wherein: the first seal means has members subjected to opposite gas pressure forces to negate the effect of the gas pressure in the valve chamber, and biasing means to bias one of the members in sliding sealing engagement with the valve means.

26. The engine of claim 25 wherein: said head plate has a cylindrical recess accommodating a lower portion of the sleeve, said members and biasing means being located in said recess.

27. The engine of claim 26 wherein: said head plate has outwardly directed pockets open to said recess, said one of the members having ears extended into said pockets to prevent rotation of the one of the members.

28. The engine of claim 19 wherein: the first seal means has an annular member spaced below the valve means, said member having an annular rib located in sliding sealing contact with the valve means inwardly of an inner portion of the annular member whereby gas pressure in the valve chamber applies force on the annular member away from the valve means, ring means located below the annular member, and biasing means forcing the ring means into engagement with ring means and holding the rib in sealing contact with the valve means, said gas pressure in the valve chamber acting on the ring means to balance the force of the gas pressure on the annular member.

29. The engine of claim 28 wherein: said head means has outwardly directed pockets located adjacent the annular member, said annular member having ears extended into said pockets to prevent rotation of said annular member.

30. The engine of claim 19 wherein: said valve means has a valve body having said combustion chamber, a recess in said body for accommodating the second seal means, said second seal means including an arcuate seal member engageable with the inside surface of the sleeve, a plurality of box seals located in said recess, at least one of the box seals having a body with inwardly and outwardly directed slits, and spring means located in said recess engageable with a box seal to bias the arcuate seal member into engagement with the inside surface of the sleeve.

31. An internal combustion engine comprising: a block having cylindrical wall means surrounding at least one piston chamber, piston means located in said piston chamber, means operable to reciprocate the piston means in said chamber, head means connected to the block, said head means having a bore open to the piston chamber, air/fuel intake and exhaust gas passages open to said bore, a cylindrical sleeve located within said bore, said sleeve having an inside cylindrical surface surrounding a valve chamber, an air/fuel intake port open to the intake passage, and an exhaust gas port circumferentially spaced from the intake port open to the exhaust gas passage, rotary valve means located in said valve chamber having a valve combustion chamber continuously open to the opening in the piston chamber and sequentially open to the air/fuel intake port and exhaust gas port for controlling the flow of air/fuel mixture into the valve combustion chamber and the flow of exhaust gas from the valve combustion chamber and piston chamber, said sleeve having an outer surface with a circumferential groove extended over the air/fuel intake port, shutter means located in said groove providing an opening between the air/fuel intake passage and the air/fuel intake port, means for moving the shutter means relative to the sleeve to vary the size of the opening and vary the timing of the closing of the air/fuel intake port, and means operable to rotate the valve means in timed relation with the movement of the piston means whereby the engine has intake, compression, power and exhaust strokes.

32. The engine of claim 31 wherein: the shutter means includes a lip projected into the intake port.

33. The engine of claim 31 wherein: the shutter means is an arcuate member having a transverse lip on the forward end thereof projected into the intake port.

34. The engine of claim 31 wherein: the means for moving the shutter means includes an elongated actuator rod, cooperating means coupling the rod to the shutter means whereby movement of the rod moves the shutter means to vary the size of the opening and vary the timing of the closing of the air/fuel intake port, and control means for moving the rod thereby changing the speed of the engine.

35. The engine of claim 34 wherein: the control means includes a foot-operated lever and linkage means connecting the lever to the rod whereby movement of the lever results in proportional movement of the rod and shutter means.

36. The engine of claim 31 wherein: said valve means has a valve body having an outside cylindrical surface spaced inwardly from the inside cylindrical surface of the sleeve, an arcuate band located in the space between the valve body and sleeve, said band having opposite ends on opposite sides of the second seal means, means connecting the band to said body whereby said band rotates with said body, and an arcuate seal member located between the opposite ends of the band, said arcuate seal member having land means located in sliding sealing engagement with the inside cylindrical surface of the sleeve.

37. The engine of claim 31 wherein: said head includes an idle and part load passage for the air/fuel mixture between the air/fuel intake passage and the air/fuel intake port, gate means located in said idle and part load passage for controlling the flow of air/fuel mixture to said intake port, and means for operating the gate means in timed relation with the rotation of the valve means whereby the gate means is closed during the flow of exhaust gas from the valve chamber and open to allow flow of the air/fuel mixture into the valve chamber.

38. The engine of claim 37 wherein: the gate means is a valve located in said idle and part load passage, said means for operating the gate means comprise drive means connecting the rotary valve means with the valve whereby the valve is operated in timed relation with the rotary valve means.

39. An internal combustion engine comprising: a block having cylindrical wall means surrounding at least one piston chamber, piston means located in said piston chamber, means operable to reciprocate the piston means in said chamber, head means connected to the block, said head means having a bore open to the piston chamber, air/fuel intake and exhaust gas passages open to said bore, a cylindrical sleeve located within said bore, said sleeve having an inside cylindrical surface surrounding a valve chamber, an air/fuel intake port open to the intake passage, and an exhaust gas port circumferentially spaced from the intake port open to the exhaust gas passage, rotary valve means located in said valve chamber having a valve combustion chamber continuously open to the opening in the piston chamber and sequentially open to the air/fuel intake port and exhaust gas port for controlling the flow of air/fuel mixture into the valve combustion chamber and the flow of exhaust gas from the valve combustion chamber and piston chamber, shutter means located adjacent said sleeve providing an opening between the air/fuel intake passage and the air/fuel intake port, means for moving the shutter means relative to the sleeve to vary the size of the opening and vary the timing of the closing of the air/fuel intake port, and means operable to rotate the valve means in timed relation with the movement of the piston means whereby the engine has intake, compression, power and exhaust strokes.

40. The engine of claim 39 wherein: the means for moving the shutter means includes an elongated actuator rod, cooperating means coupling the rod to the shutter means whereby movement of the rod moves the shutter means to vary the size of the opening and vary the timing of the closing of the air/fuel intake port, and control means for moving the rod thereby changing the speed of the engine.

41. The engine of claim 39 wherein: said valve means has a valve body having an outside cylindrical surface spaced inwardly from the inside cylindrical surface of the sleeve, an arcuate band located in the space between the valve body and sleeve, said band having opposite ends on opposite sides of the second seal means, means connecting the band to said body whereby said band rotates with said body, and an arcuate seal member located between the opposite ends of the band, said arcuate seal member having land means located in sliding sealing engagement with the inside cylindrical surface of the sleeve.

42. The engine of claim 39 wherein: said head includes an idle and part load passage for the air/fuel mixture between the air/fuel intake passage and the air/fuel intake port, gate means located in said idle and part load passage for controlling the flow of air/fuel mixture to said intake port, and means for operating the gate means in timed relation with the rotation of the valve means whereby the gate means is closed during the flow of exhaust gas from the valve chamber and open to allow flow of the air/fuel mixture into the valve chamber.

43. The engine of claim 42 wherein: the gate means is a valve located in said idle and part load passage, said means for operating the gate means comprise drive means connecting the rotary valve means with the valve whereby the valve is operated in timed relation with the rotary valve means.

* * * * *